US008487864B2

(12) United States Patent
Itoh

(10) Patent No.: US 8,487,864 B2
(45) Date of Patent: Jul. 16, 2013

(54) DISPLAY DEVICE, CONTROL DEVICE OF DISPLAY DEVICE, DRIVING METHOD OF DISPLAY DEVICE, LIQUID CRYSTAL DISPLAY DEVICE, AND TELEVISION RECEIVER

(75) Inventor: Motomitsu Itoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 826 days.

(21) Appl. No.: 12/733,120

(22) PCT Filed: May 26, 2008

(86) PCT No.: PCT/JP2008/059671
§ 371 (c)(1),
(2), (4) Date: Feb. 12, 2010

(87) PCT Pub. No.: WO2009/022486
PCT Pub. Date: Feb. 19, 2009

(65) Prior Publication Data

US 2010/0141850 A1 Jun. 10, 2010

(30) Foreign Application Priority Data

Aug. 10, 2007 (JP) ..... 2007-210343

(51) Int. Cl.
*G09G 3/36* (2006.01)

(52) U.S. Cl.
USPC ..... 345/103; 345/87

(58) Field of Classification Search
USPC ..... 345/87–103
See application file for complete search history.

(56) References Cited

U.S. PATENT DOCUMENTS

| | | | | |
|---|---|---|---|---|
| 5,410,329 | A * | 4/1995 | Tagawa et al. | 345/104 |
| 6,067,064 | A * | 5/2000 | Furuhashi et al. | 345/89 |
| 6,545,655 | B1 * | 4/2003 | Fujikawa | 345/87 |
| 7,136,040 | B1 | 11/2006 | Park | |
| 7,170,233 | B2 | 1/2007 | Adachi | |
| 7,800,571 | B2 * | 9/2010 | Leo et al. | 345/96 |
| 8,139,056 | B2 * | 3/2012 | Lee et al. | 345/211 |
| 2004/0246219 | A1 | 12/2004 | Moon | |
| 2004/0252093 | A1 | 12/2004 | Park | |
| 2006/0007075 | A1 | 1/2006 | Adachi | |
| 2007/0159441 | A1 | 7/2007 | Yang et al. | |

FOREIGN PATENT DOCUMENTS

| | | |
|---|---|---|
| JP | 11-102172 | 4/1999 |
| JP | 2000-310767 | 11/2000 |
| JP | 2003-150135 | 5/2003 |
| JP | 3576231 | 7/2004 |
| JP | 3658952 | 3/2005 |
| JP | 2006-023539 | 1/2006 |
| TW | 200502909 | 1/2005 |

* cited by examiner

*Primary Examiner* — Ricardo L Osorio
(74) *Attorney, Agent, or Firm* — Harness, Dickey & Pierce

(57) ABSTRACT

In one embodiment of the present invention, a display device includes: a display section in which a plurality of data signal lines and a plurality of scan signal lines are provided, the display section including (i) a first region including some of the plurality of scan signal lines to which a first scan signal is sequentially supplied and (ii) a second region including the others of the plurality of scan signal lines to which a second scan signal is sequentially supplied; and waveform adjusting sections for causing the first scan signal to have a waveform, during an active period, which is different from a waveform which the second scan signal has during an active period. This allows a display device, which drives a display section divided into a plurality of regions, to reduce a difference in luminance between the regions.

10 Claims, 29 Drawing Sheets

FIG. 5

| | S1 | S2 | S3 |
|---|---|---|---|
| PATTERN 1 | ○ (ON) | ○ | ○ |
| PATTERN 2 | ○ | ○ | × (OFF) |
| PATTERN 3 | ○ | × | ○ |
| PATTERN 4 | × | ○ | ○ |
| PATTERN 5 | ○ | × | × |
| PATTERN 6 | × | ○ | × |
| PATTERN 7 | × | × | ○ |
| PATTERN 8 | × | × | × |

DISPLAY DEVICE, CONTROL DEVICE OF DISPLAY DEVICE, DRIVING METHOD OF DISPLAY DEVICE, LIQUID CRYSTAL DISPLAY DEVICE, AND TELEVISION RECEIVER

TECHNICAL FIELD

The present invention relates to a scan signal (gate on pulse) supplied to a scan signal line of a display device.

BACKGROUND ART

In order to deal with (i) shortening of writing time to each pixel due to a high definition of a display device such as a liquid crystal display device and (ii) a blunt signal waveform caused by large scale of the display device, a configuration has been proposed in which a display section of the display device is divided into a plurality of regions and the regions are separately driven. For example, Patent Literature 1 discloses a display device in which a display section is divided into a first region and a second region (see FIG. 30). In the first region, a plurality of source lines (HS1 through HSm) and a plurality of gate lines (G1 through G(n/2)) are provided. In the second region, a plurality of source lines (HS1' through HSm') and a plurality of gate lines (G(n/2+1) through Gn) are provided. According to the display device, the first region is driven by a source driver 102 and a gate driver 103; and the second region is driven by a source driver 102' and a gate driver 103'.

Patent Literature 1

Japanese Patent Application Publication, Tokukaihei, No. 11-102172 A (Publication Date: Apr. 13, 1999)

SUMMARY OF INVENTION

According to a configuration in which a display section is divided into a plurality of regions, line widths of the respective gate lines, etc. vary depending on formation conditions of the regions. This causes the regions to have different luminance even when the regions are displayed in an identical tone. In this case, the inventors have found that a difference in luminance between the respective regions becomes highly noticeable and a border between the respective regions may ultimately be recognized, if the regions are separately driven with the configuration.

The present invention is accomplished in view of the problem, and its object is to provide a configuration which can prevent a difference in luminance between respective regions in a display device in which a display section is divided into a plurality of regions and the respective plurality of regions are separately driven.

A display device of the present invention includes: a display section in which a plurality of data signal lines and a plurality of scan signal lines are provided, the display section including (i) a first region including some of the plurality of scan signal lines to which a first scan signal is sequentially supplied and (ii) a second region including the others of the plurality of scan signal lines to which a second scan signal is sequentially supplied; and a waveform adjusting section which causes the first scan signal to have a waveform, during an active period, which is different from a waveform which the second scan signal has during an active period According to the configuration, in a case where the first region has luminance different from that of the second region even when the regions are displayed in an identical tone, the difference in luminance can be reduced, with the use of the waveform adjusting section, by causing the first scan signal to have a waveform, during an active period, which is different from a waveform which the second scan signal has during an active period. This makes it difficult for a border between the respective regions to be recognized.

A display device of the present invention includes: a display section in which a plurality of data signal lines and a plurality of scan signal lines are provided, the display section including (i) a first region where some of the plurality of scan signal lines are provided and (ii) a second region where the others of the plurality of scan signal lines are provided, a first scan signal being generated so as to correspond to the first region, and a second scan signal being generated so as to correspond to the second scan region; and a timing adjusting section which causes a timing, at which an active period of the first scan signal starts during a data signal outputting period, to be different from a timing at which an active period of the second scan signal starts during the data signal outputting period.

According to the configuration, the timing, at which the active period of the first scan signal starts during a data signal outputting period, is made to be different from the timing, at which the active period of the second scan signal starts during the data signal outputting period. This allows the difference in luminance to be reduced. Accordingly, the border between the respective regions becomes difficult to be recognized.

The display device may include a waveform adjusting section control section which controls the waveform adjusting section in accordance with inputted adjusting data. With the configuration, the waveform adjusting section can be conveniently controlled automatically. Moreover, the display device may include a timing adjusting section controlling circuit which controls the timing adjusting section in accordance with inputted adjusting data.

The display device may include a memory which stores the adjusting data. With the configuration, the adjustment data can be conveniently set up by writing the data into the memory.

According to the display device, the waveform adjusting section may cause the first scan signal to have a width of an active period which is different from that of the second scan signal.

According to the display device, each of the first scan signal and the second scan signal may at least partially has a slope falling edge at an end of the active period. According to the display device, the waveform adjusting section may cause the first scan signal to have a degree, to which the falling edge slopes, which is different from a degree of the second scan signal.

According to the display device, the waveform adjusting section may cause the first scan signal to have a start timing of the falling edge which start timing is different from a start timing of the falling edge of the second scan signal.

According to the display device, the waveform adjusting section may cause the first scan signal to have a steepness of the rising edge which steepness is different from that of the second scan signal.

According to the display device, the waveform adjusting section may cause the first scan signal to have a steepness of the falling edge which steepness is different from that of the second scan signal.

According to the display device, the waveform adjusting section may cause the first scan signal to have a voltage, during an active period, which is different from a voltage which the second scan signal has during an active period.

According to the display device, the first scan signal may be generated with use of a first clock signal, and the second scan signal may be generated with use of a second clock signal.

According to the display device, the timing adjustment section may cause the first clock signal to have a phase which is different from that of the second clock signal, when the data signal starts being outputted.

The display device may further include: a first scan signal line driving circuit corresponding to the first region; and a second scan signal line driving circuit corresponding to the second region, the first scan signal line driving circuit generating the first scan signal with use of a first scan voltage, and the second scan signal line driving circuit generating the second scan signal with use of a second scan voltage.

The display device may further include: a first scan voltage generating circuit which generates the first scan voltage; and a second scan voltage generating circuit which generates the second scan voltage, at least one of the first scan voltage generating circuit and the second scan voltage generating circuit including the waveform adjusting section.

According to the display device: the first scan voltage generating circuit may cause a constant voltage to have a periodical change so as to generate the first scan voltage; and the second scan voltage generating circuit may cause a constant voltage to have a periodical change so as to generate the second scan voltage.

According to the display device: the first scan voltage generating circuit may cause a constant voltage to increase or decrease so as to generate the first scan voltage; and the second scan voltage generating circuit may cause a constant voltage to increase or decrease so as to generate the second scan voltage.

According to the display device, it is possible that: each of the first scan voltage generating circuit and the second voltage generating circuit includes a first transistor, a second transistor, a first resistor, a second resistor, and a diode; the first transistor has (i) a collector terminal connected to a constant-voltage regulated power supply and (ii) an emitter terminal connected to a corresponding one of the first and second scan signal line driving circuits; the second transistor has a first conductive terminal which is grounded and a control terminal to which a signal is supplied for controlling a timing causing the periodical change; the first resistor is provided between the collector terminal of and a base terminal of the first transistor; the second resistor is provided between the base terminal of the first transistor and a second conductive terminal of the second transistor; and the diode has (i) an anode terminal connected to the emitter terminal of the first transistor and (ii) a cathode terminal connected to the base terminal of the first transistor. In this case, at least one of the first scan voltage generating circuit and the second voltage generating circuit includes a waveform adjusting section, serving as a variable resistor, which is provided in parallel with the second resistor. Moreover, at least one of the first scan voltage generating circuit and the second voltage generating circuit may include a waveform adjusting section, serving as a variable resistor, which is provided in parallel with the first resistor.

According to the display device, it is possible that: each of the first scan voltage generating circuit and the second scan voltage generating circuit includes a first transistor, a second transistor, a first resistor, a second resistor, and a diode; the first transistor has a collector terminal connected to a constant-voltage regulated power supply; the second transistor has a first conductive terminal which is grounded and a control terminal to which a signal is supplied for controlling a timing causing the periodical change; the first resistor is provided between the collector terminal of and a base terminal of the first transistor; the second resistor is provided between the base terminal of the first transistor and a second conductive terminal of the second transistor; the diode has (i) an anode terminal connected to the emitter terminal of the first transistor and (ii) a cathode terminal connected to the base terminal of the first transistor; and at least one of the first scan voltage generating circuit and the second scan voltage generating circuit includes a waveform adjusting section, serving as a variable resistance, which is provided between the emitter terminal of the first transistor and a corresponding one of the first and second scan signal line driving circuits.

According to the display device, it is possible that: each of the first scan voltage generating circuit and the second scan voltage generating circuit includes a third transistor, a third resistor, and a zener diode; the third transistor has (i) a collector terminal connected to a constant-voltage regulated power supply and (ii) an emitter terminal connected to a corresponding one of the first and second scan signal line driving circuits; the zener diode has (i) an anode terminal which is grounded and (ii) a cathode terminal connected to a base terminal of the third transistor; and the third resistor is provided between the collector terminal of the third transistor and the base terminal of the third transistor. In this case, at least one of the first scan voltage generating circuit and the second scan voltage generating circuit includes a waveform adjusting section, serving as a variable resistance, which is provided in parallel with the third resistor.

According to the display device, it is possible that: each of the first scan voltage generating circuit and the second scan voltage generating circuit includes a third transistor, a third resistor, and a zener diode; the third transistor has a collector terminal connected to a constant-voltage regulated power supply; the zener diode has (i) an anode terminal which is grounded and (ii) a cathode terminal connected to a base terminal of the third transistor; the third resistor is provided between the collector terminal of the third transistor and the base terminal of the third transistor; and at least one of the first scan voltage generating circuit or the second scan voltage generating circuit includes a waveform adjusting section, serving as a variable resistance, which is provided between the emitter terminal of the third transistor and a corresponding one of the first and second scan signal line driving circuits.

According to the display device, it is possible that: each of the first scan voltage generating circuit and the second scan voltage generating circuit includes a fourth resistor and a fifth resistor, and an amplifier circuit; the amplifier circuit has (i) a positive phase terminal connected to a constant-voltage regulated power supply and (ii) an output terminal connected to a corresponding one of the first and second scan signal line driving circuits; one end of the fourth resistor is grounded and the other end is connected to a negative phase terminal of the amplifier circuit; and the fifth resistor is provided between the negative phase terminal of and the output terminal of the amplifier circuit. In this case, at least one of the first scan voltage generating circuit and the second scan voltage generating circuit includes a waveform adjusting section, serving as a variable resistance, which is provided in parallel with the fifth resistor.

It is possible that the display device includes: a first scan signal line driving circuit corresponding to the first region; and a second scan signal line driving circuit corresponding to the second region, the first scan signal line driving circuit generating the first scan signal with use of a first clock signal, and the second scan signal line driving circuit generating the second scan signal with use of a second clock signal.

It is possible that the display device includes: a first timing control circuit which generates the first clock signal; and a second timing control circuit which generates the second clock signal, at least one of the first timing control circuit and the second timing control circuit including the timing adjusting section.

According to the display device, it is possible that, the display panel is divided into a first region including an upper half of the plurality of scan signal lines and a second region including a lower half of the plurality of scan signal lines, a direction orthogonal to the plurality of scan signal lines being an up-and-down direction.

According to the display device, it is possible that, the display panel is divided into a first region including a left half of the plurality of scan signal lines and a second region including a right half of the plurality of scan signal lines, a direction in which the plurality of scan signal lines are extended being a horizontal direction.

A control device of the present invention (e.g., a control device provided in a display device) is a control device for use in a display device including: a display section in which a plurality of data signal lines and a plurality of scan signal lines are provided, the display section including (i) a first region including some of the plurality of scan signal lines and (ii) a second region including the others of the plurality of scan signal lines, first and second scan signals being generated so as to correspond to the first and second regions, respectively; and a waveform adjusting section which causes the first scan signal to have a waveform, during an active period, which is different from a waveform which the second scan signal has during an active period.

A control device of the present invention is a control device for use in a display device including: a display section in which a plurality of data signal lines and a plurality of scan signal lines are provided, the display section including (i) a first region including some of the plurality of scan signal lines and (ii) a second region including the others of the plurality of scan signal lines, first and second scan signals being generated so as to correspond to the first and second regions, respectively; and a timing adjusting section which causes a timing, at which an active period of the first scan signal starts during a data signal outputting period, to be different from a timing at which an active period of the second scan signal starts during the data signal outputting period.

A driving method of the present invention is a driving method for driving a display device including: a display section in which a plurality of data signal lines and a plurality of scan signal lines are provided, the display section including (i) a first region including some of the plurality of scan signal lines and (ii) a second region including the others of the plurality of scan signal lines, first and second scan signals being generated so as to correspond to the first and second regions, respectively, the driving method comprising the step of: causing the first scan signal to have a waveform, during an active period, which is different from a waveform which the second scan signal has during an active period.

A driving method of the present invention is a driving method for driving a display device including: a display section in which a plurality of data signal lines and a plurality of scan signal lines are provided, the display section including (i) a first region including some of the plurality of scan signal lines and (ii) a second region including the others of the plurality of scan signal lines, first and second scan signals being generated so as to correspond to the first and second regions, respectively, the driving method comprising the step of: causing a timing, at which an active period of the first scan signal starts during a data signal outputting period, to be different from a timing at which an active period of the second scan signal starts during the data signal outputting period.

A liquid crystal display device of the present invention includes the display device. Moreover, a television receiver of the present invention includes the liquid crystal display device and a tuner section which receives television broadcasting.

As described above, according to the display device, in a case where the first and second regions have different luminance even when the regions are displayed in an identical tone, the waveform adjusting section causes the first scan signal to have a waveform, during an active period, which is different from a waveform which the second scan signal has during an active period. This makes it possible to reduce the difference in luminance.

BRIEF DESCRIPTION OF DRAWINGS

FIG. 5 is an explanatory table illustrating setting examples of the waveform adjusting section.

REFERENCE SIGNS LIST

1: Liquid Crystal Display Device
2: Display Section
3: Driver Control Circuit
5: First Timing Controller
5*a*: Waveform Adjusting Section
5*b*: Timing Adjusting Section
6: Second Timing Controller
6*a*: Waveform Adjusting Section
6*b*: Timing Adjusting Section
7: First Scan Voltage Generating Circuit
7*x*: Waveform Generating Section
7*y*: Waveform Adjusting Section
8: Second Scan Voltage Generating Circuit
8*x*: Waveform Generating Section
8*y*: Waveform Adjusting Section
11: Constant-voltage Regulated Power Supply
35: LSI
45: Memory
FA: First Region (in Display Section)
SA: Second Region (in Display Section)
GDF: First Gate Driver
GDS: Second Gate Driver

DESCRIPTION OF EMBODIMENTS

The following describes one embodiment of the present invention with reference to FIGS. 1 through 29.

Figure 1:
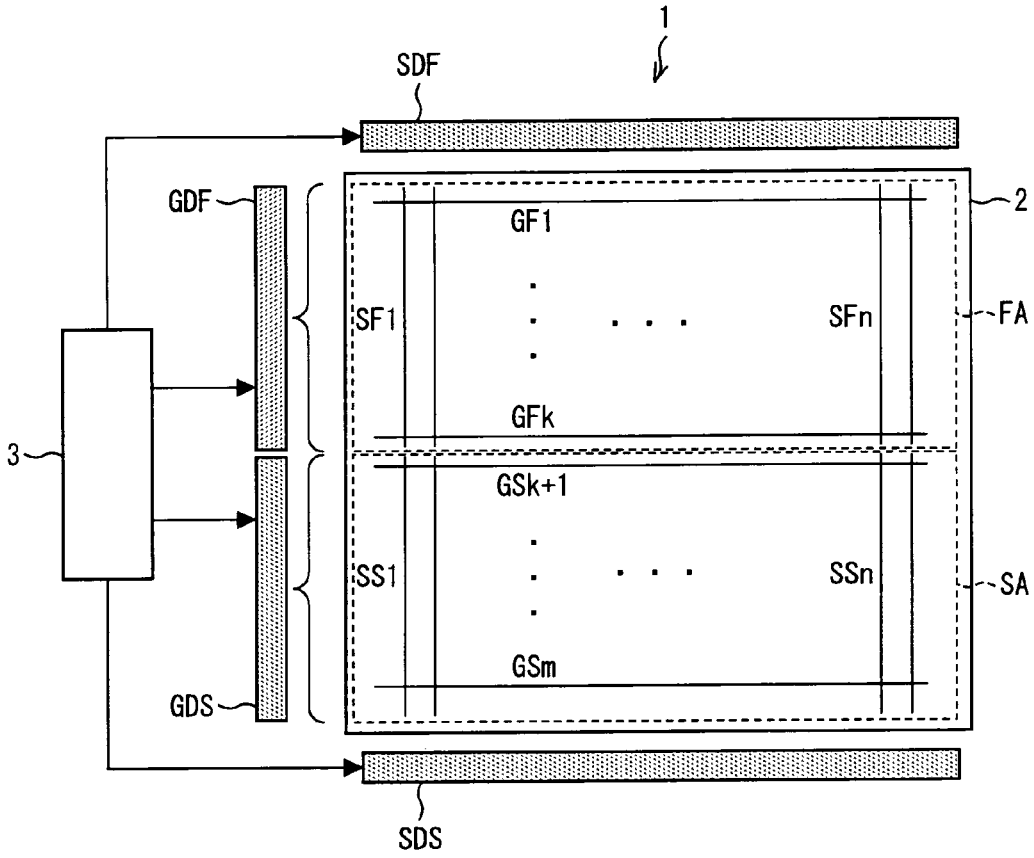
FIG. 1 is a schematic view illustrating a configuration of a liquid crystal display device of the present invention.

FIG. 1 is a block diagram illustrating a configuration of a liquid crystal display device of the present invention. As shown in FIG. 1, a liquid crystal display device 1 of the present embodiment includes: a display section 2; a first gate driver GDF (a first scan signal line driving circuit); a second gate driver GDS (a second scan signal line driving circuit); a first source driver SDF; a second source driver SDS; and a driver control circuit 3. The display section 2 is divided into a first region FA and a second region SA which are separately driven. The first region FA includes data signal lines SF1 through SFn and scan signal lines GF1 through GFk. The second region SA includes data signal lines SS1 through SSn and scan signal lines GSk+1 through GSm. That is, the data signal lines SF1 through SFn included in the first region FA are driven by the first source driver SDF, the scan signal lines GF1 through GFk included in the first region FA are driven by the first gate driver GDF, the data signal lines SS1 through SSn included in the second region SA are driven by the second source driver SDS, and the scan signal lines GSk+1 through GSm included in the second region SA are driven by the second gate driver GDS. Note that the driver control circuit 3 controls the first gate driver GDF, the second gate driver GDS, the first source driver SDF, and the second source driver SDS.

Embodiment 1

Figure 2:
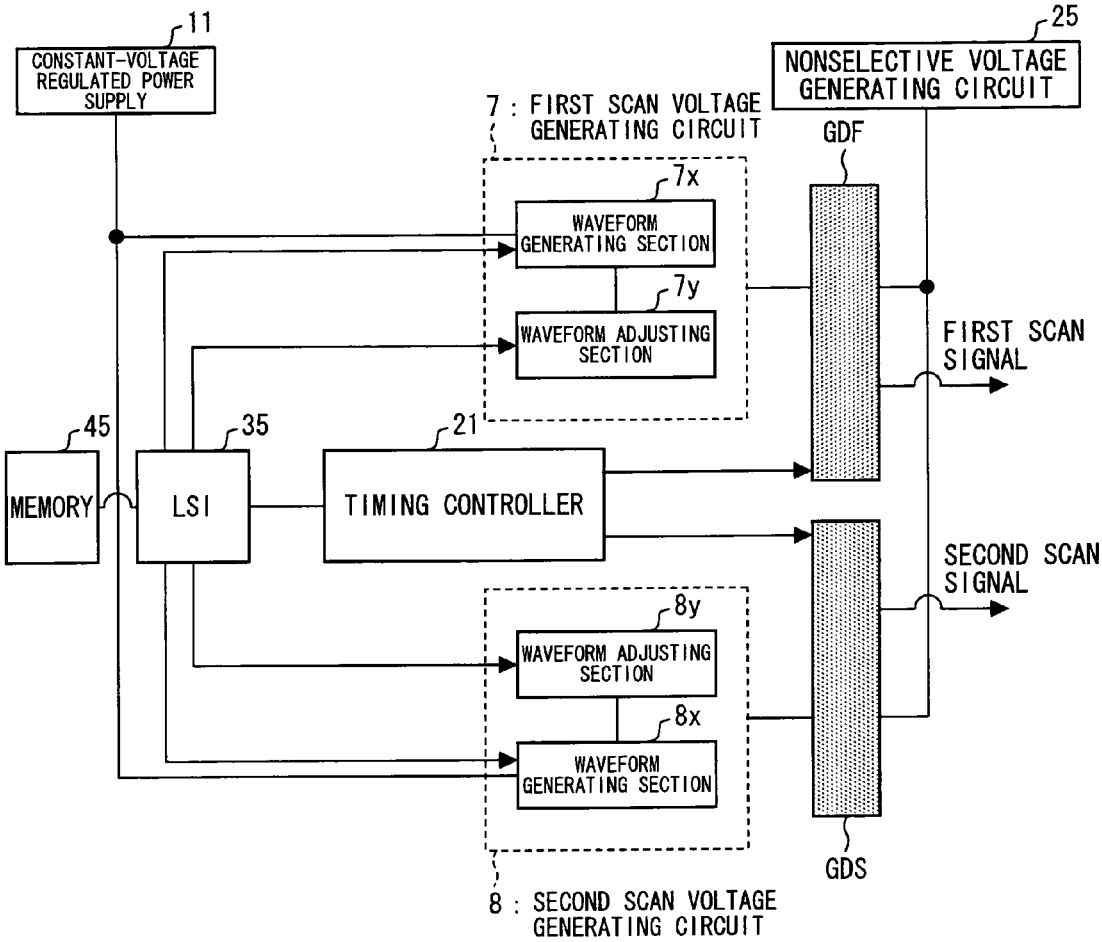
FIG. 2 is a block diagram illustrating a configuration (a configuration example of a driver control circuit shown in FIG. 1) according to Embodiment 1.

FIG. 2 is a block diagram illustrating a part of the driver control circuit 3 shown in FIG. 1 and the first and second gate drivers GDF and GDS. As shown in FIG. 2, the driver control circuit 3 includes: a constant-voltage regulated power supply 11; a nonselective voltage generating circuit 25; a memory 45; an LSI 35 (a waveform adjusting section controlling circuit); a timing controller 21; a first scan voltage generating circuit 7; and a second scan voltage generating circuit 8. Note that the first scan voltage generating circuit 7 includes a waveform generating section 7*x* and a waveform adjusting section 7*y*, and the second scan voltage generating circuit 8 includes a waveform generating section 8*x* and a waveform adjusting section 8*y*.

The first scan voltage generating circuit 7 converts a constant voltage supplied from the constant-voltage regulated power supply 11 so that the converted voltage corresponds to the first region FA, and outputs to the first gate driver GDF, as a first scan voltage, the converted voltage. Moreover, the second scan voltage generating circuit 8 converts a constant voltage supplied from the constant-voltage regulated power supply 11 so that the converted voltage corresponds to the second region SA, and outputs to the second gate driver GDS, as a second scan voltage, the converted voltage. The timing controller 21 (i) outputs a GCK (gate clock pulse) to each of the first and second gate drivers GDF and GDS, and (ii) outputs to the waveform generating sections 7*x* and 8*x* a pulse signal for generating the first and second scan voltages. The LSI 35 controls the waveform adjusting sections 7*y* and 8*y* in accordance with data read out from the memory 45. Note that the pulse signal for generating the first and second scan voltages can be outputted from the timing controller 21 to the waveform generating sections 7*x* and 8*x*, via the LSI 35.

The first gate driver GDF generates the first scan signal in accordance with (i) the first scan voltage supplied from the first scan voltage generating circuit 7, (ii) a nonselective voltage supplied from the nonselective voltage generating circuit 25, and (iii) a GCK supplied from the timing controller 21, and then sequentially outputs the first scan signal to the scan signal lines (GF1 through GFk) in the first region FA. Moreover, the second gate driver GDS generates the second scan signal in accordance with (i) the second scan voltage supplied from the second scan voltage generating circuit 8, (ii) a nonselective voltage supplied from the nonselective voltage generating circuit 25, and (iii) a GCK supplied from the timing controller 21, and then sequentially outputs the second scan signal to the scan signal lines (GSk+1 through GSm) in the second region SA.

Figure 3:
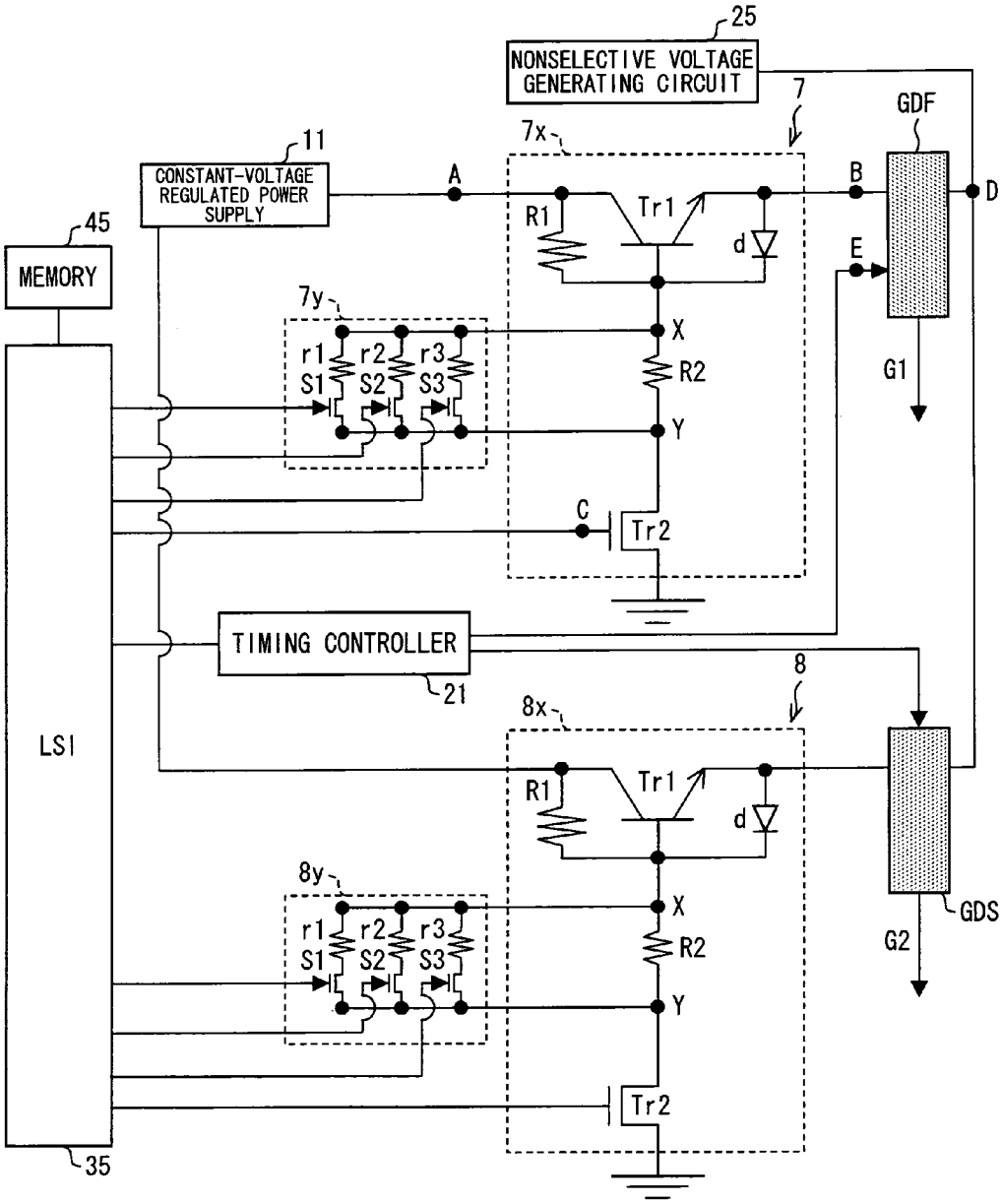
FIG. 3 is a circuit diagram illustrating a specific example of the configuration shown in FIG. 2.

FIG. 3 is a circuit diagram specifically illustrating the configuration shown in FIG. 2. As shown in FIG. 3, the waveform generating section 7*x* includes: a transistor Tr1 (a first transistor) which is an NPN bipolar transistor; resistors R1 and R2 (first and second resistors); a diode d; and a transistor Tr2 (a second transistor) which is an N-channel FET. The transistor Tr1 has (i) a collector terminal connected to the constant-voltage regulated power supply 11 and (ii) an emitter terminal connected to the first gate driver GDF. The transistor Tr2 has (i) a source terminal which is grounded and (ii) a gate terminal connected to the LSI 35. The resistor R1 is provided between the collector terminal of the transistor Tr1 and a base terminal of the transistor Tr1. The diode d has (i) an anode terminal connected to the emitter terminal of the transistor Tr1 and (ii) a cathode terminal connected to the base terminal of the transistor Tr1. The base terminal of the transistor Tr1 is connected to a node X. A drain terminal of the transistor Tr2 is connected to a node Y. The resistor R2 is provided between the node X and the node Y. Moreover, the waveform adjusting section 7*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, in the first scan voltage generating circuit 7, the waveform adjusting section 7*y* is provided in parallel with the resistor R2 which is provided, in the waveform generating section 7*x*, between the base terminal of the transistor Tr1 and the drain terminal of the transistor Tr2.

Similarly, the waveform generating section 8*x* includes: a transistor Tr1 which is an NPN bipolar transistor; resistors R1 and R2; a diode d; and a transistor Tr2 which is an N-channel FET. The transistor Tr1 has (i) a collector terminal connected to the constant-voltage regulated power supply 11 and (ii) an emitter terminal connected to the second gate driver GDS. The transistor Tr2 has (i) a source terminal which is grounded and (ii) a gate terminal connected to the LSI 35. The resistor R1 is provided between the collector terminal of the transistor Tr1 and a base terminal of the transistor Tr1. The diode d has (i) an anode terminal connected to the emitter terminal of the transistor Tr1 and (ii) a cathode terminal connected to the base terminal of the transistor Tr1. The base terminal of the transistor Tr1 is connected to a node X. A drain terminal of the transistor Tr2 is connected to a node Y. The resistor R2 is provided between the node X and the node Y. Moreover, the waveform adjusting section 8*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, in the second scan voltage generating circuit 8, the waveform adjusting section 8*y* is provided in parallel with the resistor R2 which is provided, in the waveform generating section 8*x*, between the base terminal of the transistor Tr1 and the drain terminal of the transistor Tr2.

Figure 4:
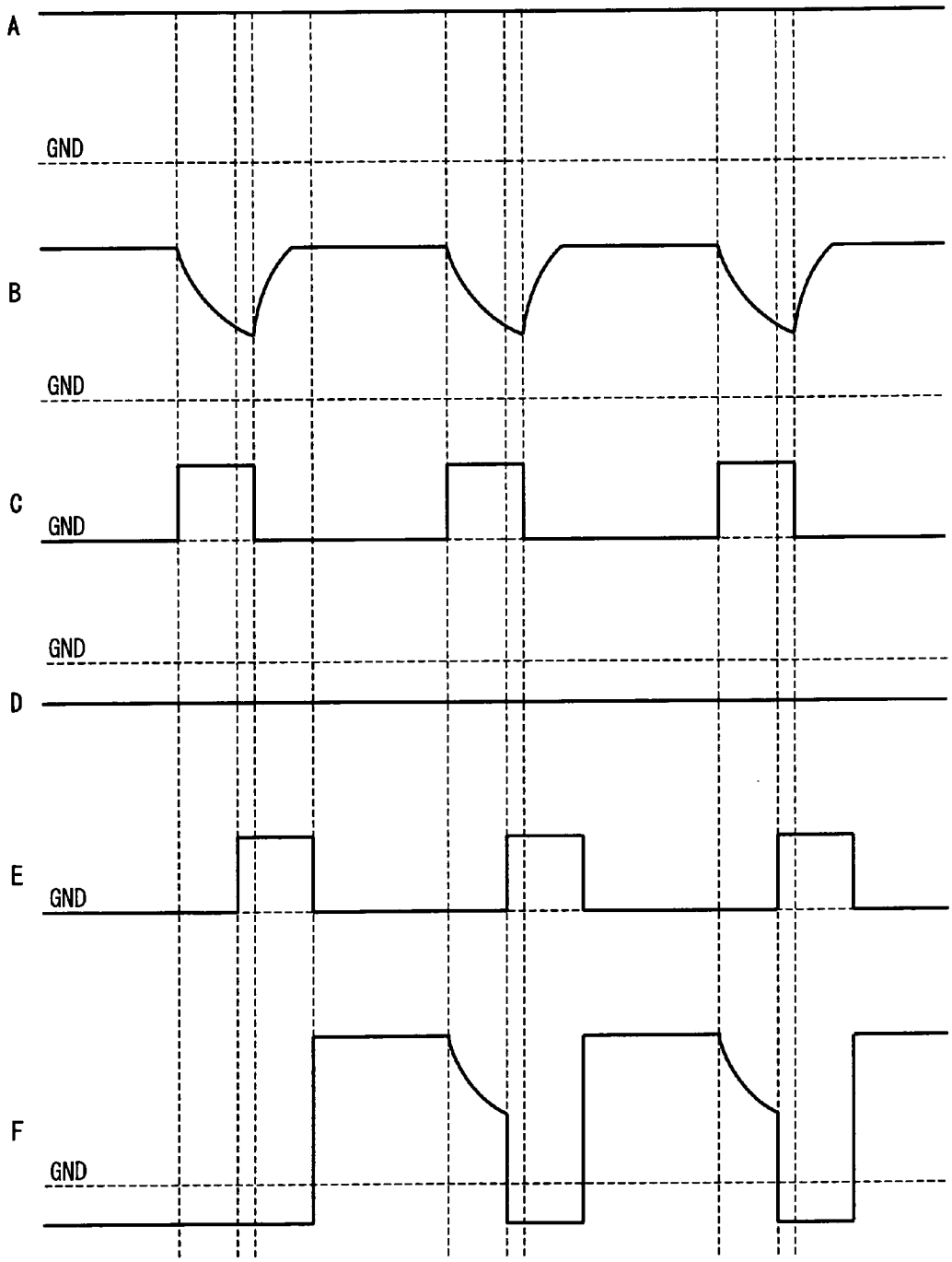
FIG. 4 is a timing chart illustrating waveforms of the components shown in FIG. 3.
Figure 6:
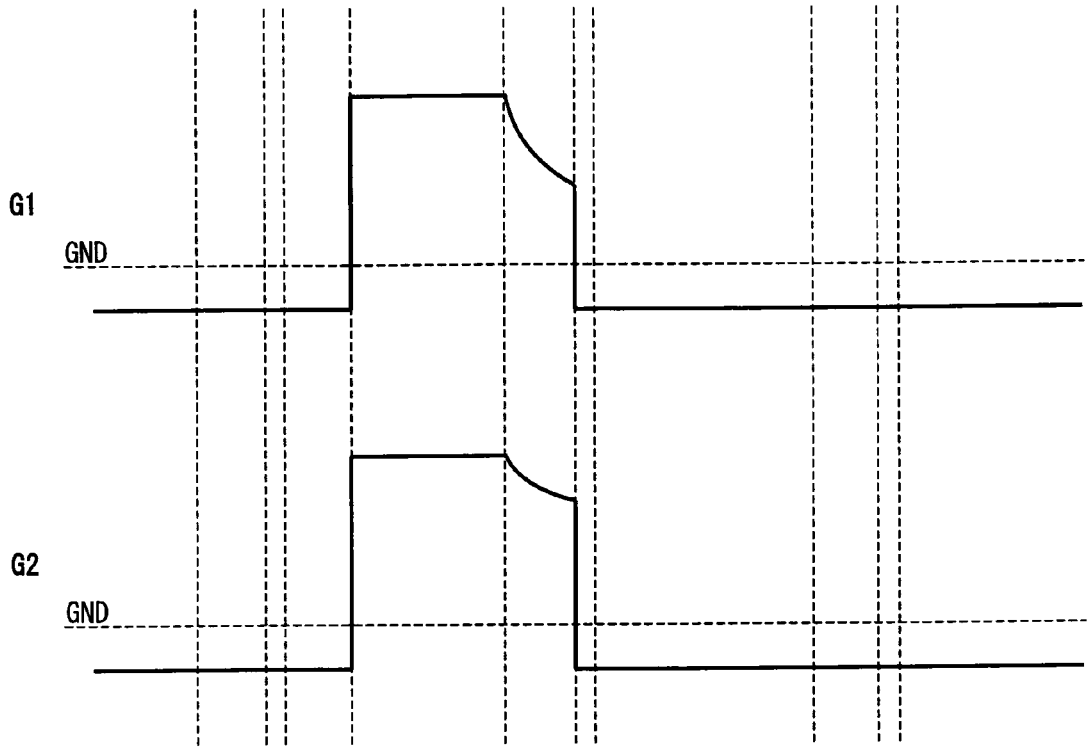
FIG. 6 is a graph illustrating waveforms of a first scan signal and a second scan signal in their active periods.

FIG. 4 illustrates waveforms of A through F, where A is an output of the constant-voltage regulated power supply 11, B is an input to the first gate driver GDF, C is an input (a pulse signal) to the gate terminal of the transistor Tr2, D is an output of the nonselective voltage generating circuit 25, E is an input (GCK) to the first gate driver GDF from the timing controller 21, and F is a voltage pulse generated at the first gate driver GDF.

The constant-voltage regulated power supply 11 supplies an output A to the collector terminal of the transistor Tr1. After predetermined time has elapsed since the transistor Tr2 is turned OFF (i.e., the transistor Tr2 receives an input C of "L" via the gate terminal), a base current and a collector current of the transistor Tr1 becomes constant. This causes the GDF to receive an input B of a constant voltage VGH. During the state, in a case where the transistor Tr2 turns ON (i.e., the transistor Tr2 receives an input C of "H" via the gate terminal), a current flows through the diode d, and therefore the transistor Tr1 turns OFF. This causes the input B to start decreasing from the VGH. Further, during the state, in a case where the transistor Tr2 turns OFF (i.e., the transistor Tr2 receives an input C of "L" via the gate terminal) a current starts flowing through the collector of the transistor Tr1. This causes the input B to start increasing toward the VGH. And, after predetermined time has elapsed, the base current and the collector current of the transistor Tr1 becomes constant, and this causes the input B to become the VGH. The first scan voltage generating circuit 7 causes the constant voltage of the constant-voltage regulated power supply 11 to have a waveform of a saw-edged shape, and then the voltage having the waveform of the saw-edged shape is supplied to the first gate driver GDF. Moreover, the first gate driver GDF receives, from the nonselective voltage generating circuit 25, a constant voltage represented by D which is less than a GND voltage. That is, the first gate driver GDF selects a voltage (a nonselective voltage) supplied from the nonselective voltage generating circuit 25 during a period where an input E (GCK) of the timing controller 21 is "H". Whereas, during a period where the GCK is "L", the first gate driver GDF selects a voltage (a first scan voltage) supplied from the first scan voltage generating circuit 7. This causes a voltage pulse to have a slope falling edge (return part) as shown by F in FIG. 4. Then, the first gate driver GDF sequentially outputs, to the scan signal lines (GF1 through GFk), a first scan signal (gate on pulse signal) in which such a voltage pulse rises in an active period of the first scan signal.

The waveform adjusting section 7*y* sets a resistance between the nodes X and Y in the first scan voltage generating circuit 7. Specifically, each of the transistors S1 through S3 is turned ON or OFF in accordance with a signal from the LSI 35. FIG. 5 illustrates patterns (patterns 1 through 8) of combinations of ON and OFF of the transistors S1 through S3. More specifically, S1 is ON, S2 is ON, and S3 is ON in a pattern 1; S1 is ON, S2 is ON, and S3 is OFF in a pattern 2; 51 is ON, S2 is OFF, and S3 is ON in a pattern 3; S1 is OFF, S2 is ON, and S3 is ON in a pattern 4; S1 is ON, S2 is OFF, and S3 is OFF in a pattern 5; S1 is OFF, S2 is ON, and S3 is OFF in a pattern 6; S1 is OFF, S2 is OFF, and S3 is ON in a pattern 7; and S1 is OFF, S2 is OFF, and S3 is OFF in a pattern 8. For example, in the pattern 4, the resistance between the nodes X and Y in the first scan voltage generating circuit 7 is equal to a combined resistance of the resistor r2, the resistor r3, and the resistor R2.

Note that, in a case where the resistance between the nodes X and Y is large, the voltage pulse has a gentle slope falling edge. Whereas, in a case where the resistance between the nodes X and Y is small, the pulse signal has a steep slope falling edge (see FIG. 6). Accordingly, for example, in a case where luminance becomes lower in the second region SA than in the first region FA while displays of an identical tone are being carried out, it is only necessary that the second scan signal G2, which is outputted from the second gate driver GDS, has a falling edge whose slope is gentler than that of the first scan signal G1 which is outputted from the first gate driver GDF (see FIG. 6). As such, the resistance between the nodes X and Y in the second scan voltage generating circuit 8 becomes larger than the resistance between the nodes X and Y in the first scan voltage generating circuit 7. This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set. Note that the adjusting data is preferable to be set for each panel.

Figure 7:
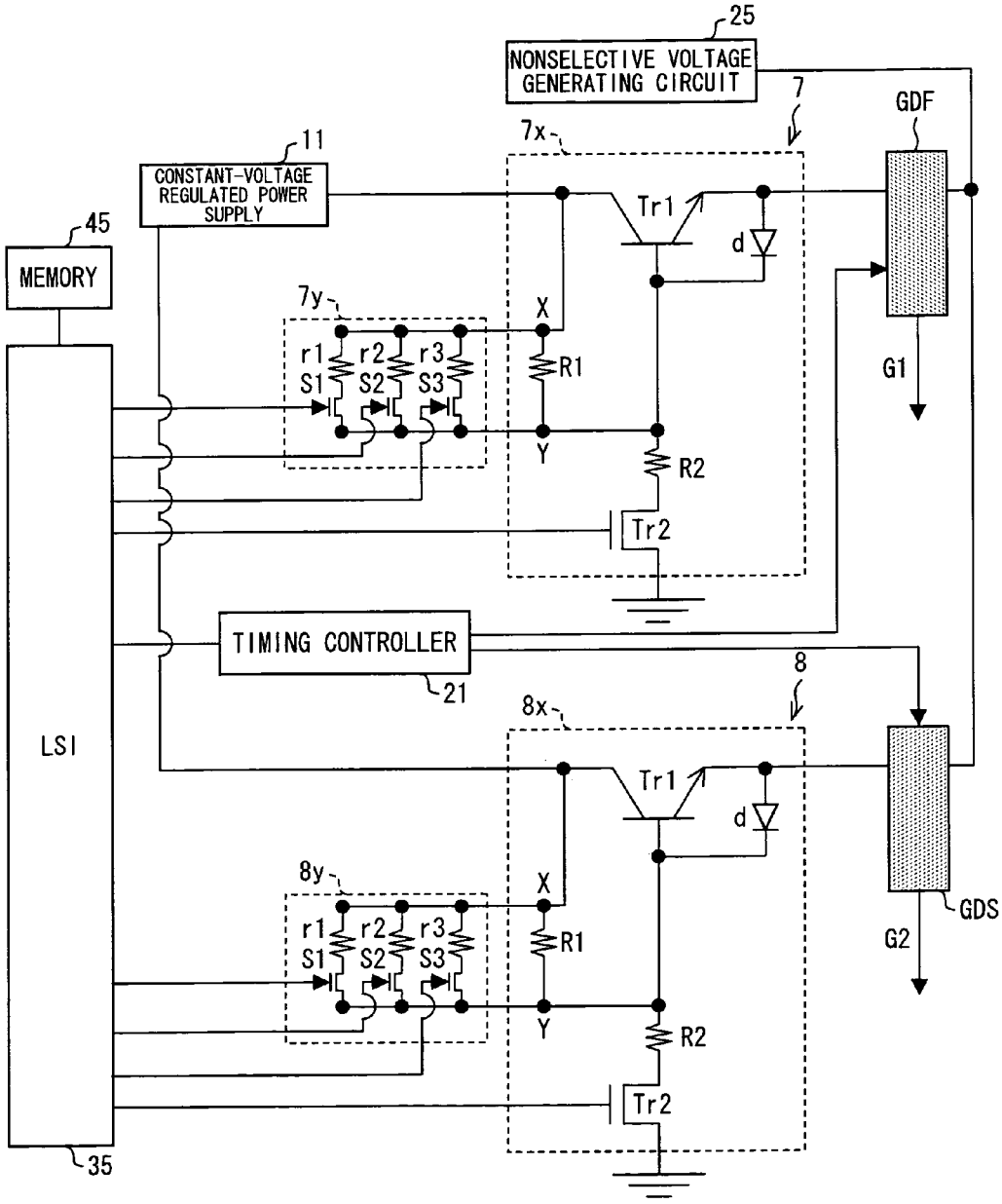
FIG. 7 is a circuit diagram illustrating another specific example of the configuration shown in FIG. 2.

FIG. 7 is a circuit diagram illustrating another specific example of the configuration shown in FIG. 2. As shown in FIG. 7, the waveform generating section 7*x* includes a transistor Tr1 which is an NPN bipolar transistor; resistors R1 and R2; a diode d; and a transistor Tr2 which is an N-channel FET. According to the configuration: The transistor Tr1 has (i) a collector terminal connected to the constant-voltage regulated power supply 11 and (ii) an emitter terminal connected to the first gate driver GDF.

The transistor Tr2 has (i) a source terminal which is grounded and (ii) a gate terminal connected to the LSI 35. The resistor R1 is provided between the collector terminal of the transistor Tr1 and a base terminal of the transistor Tr1. The diode d has (i) an anode terminal connected to the emitter terminal of the transistor Tr1 and (ii) a cathode terminal connected to the base terminal of the transistor Tr1. The collector terminal of the transistor Tr1 is connected to a node X, and the resistor R2 is provided between a drain terminal of the transistor Tr2 and a node Y. Moreover, the waveform adjusting section 7*y* includes three resistors r1 through r3, and three transistors S1 through S3. More specifically, the resistors r1 through r3 are connected in series with the three transistors 51 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors 51 through S3 are connected to the LSI 35. That is, in the first scan voltage generating circuit 7, the waveform adjusting section 7*y* is provided in parallel with the resistor R1. Note that the waveform generating section 8*x* and the waveform adjusting section 8*y* in the second scan voltage generating circuit 8 have respective same configurations as those of the waveform generating section 7*x* and the waveform adjusting section 7*y*, except that an emitter terminal of the transistor Tr1 in the waveform generating section 8*x* is connected to the second gate driver GDS.

According to the configuration shown in FIG. 7, a slope of a falling edge of the voltage pulse is also changed in accordance with a change in resistance between the nodes X and Y. Accordingly, for example, in a case where luminance becomes lower in the second region SA than in the first region FA while displays of an identical tone are being carried out, it is only necessary that the second scan signal, which is outputted from the second gate driver GDS, has a falling edge whose slope is gentler than that of the first scan signal which is outputted from the first gate driver GDF. This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set.

Figure 8:
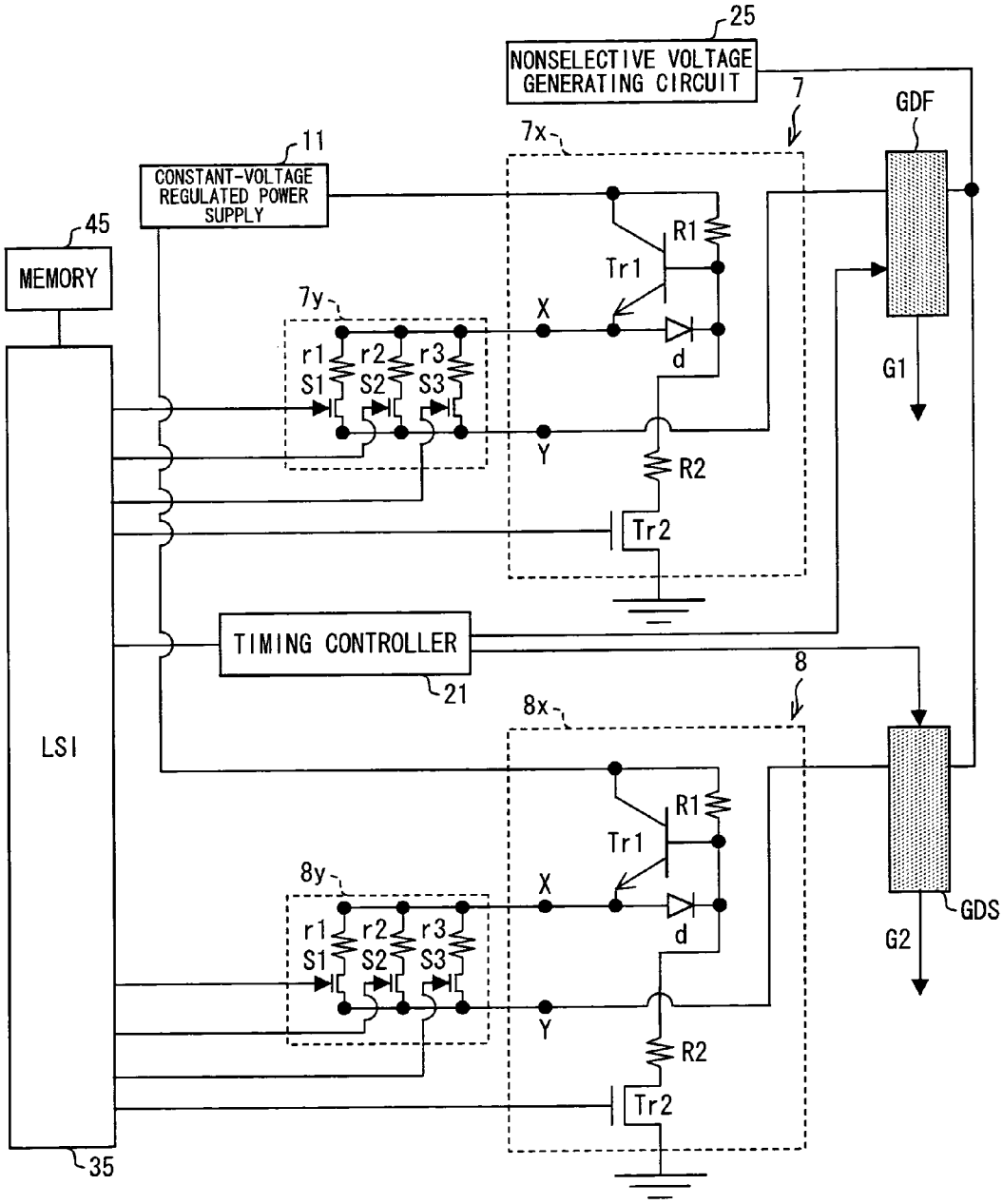
FIG. 8 is a circuit diagram illustrating another specific example of the configuration shown in FIG. 2.

FIG. 8 is a circuit diagram illustrating a further specific example of the configuration shown in FIG. 2. As shown in FIG. 8, the waveform generating section 7*x* includes a transistor Tr1 which is an NPN bipolar transistor; resistors R1 and R2; a diode d; and a transistor Tr2 which is an N-channel FET. The transistor Tr1 has (i) a collector terminal connected to the constant-voltage regulated power supply 11 and (ii) an emitter terminal connected to a node X. The transistor Tr2 has (i) a source terminal which is grounded, (ii) a gate terminal connected to the LSI 35, and a drain terminal connected to a base terminal of the transistor Tr1 via the resistor R2. The resistor R1 is provided between a collector terminal of the transistor Tr1 and a base terminal of the transistor Tr1. The diode d has (i) an anode terminal connected to the emitter terminal of the transistor Tr1 and (ii) a cathode terminal connected to the base terminal of the transistor Tr1. Node Y is connected to the first gate driver GDF. Moreover, the waveform adjusting section 7*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, in the first scan voltage generating circuit 7, the waveform adjusting section 7*y* is provided between (i) the node X connected to the emitter terminal of the transistor Tr1 and (ii) the node Y connected to the first gate driver GDF. Note that, the waveform generating section 8*x* and the waveform adjusting section 8*y* in the second scan voltage generating circuit 8 have respective same configurations as those of the waveform generating section 7*x* and the waveform adjusting section 7*y*, except that an emitter terminal of the transistor Tr1 of the waveform generating section 8*x* is connected to the second gate driver GDS.

According to the configuration shown in FIG. 8, a slope of a falling edge of the voltage pulse is also change in accordance with a change in resistance between the nodes X and Y. Accordingly, for example, in a case where luminance becomes lower in the second region SA than in the first region FA while displays of an identical tone are being carried out, it is only necessary that the second scan signal, which is outputted from the second gate driver GDS, has a falling edge whose slope is gentler than that of the first scan signal which is outputted from the first gate driver GDF. This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set.

In the present embodiment, the first scan voltage generating circuit 7 and the second scan voltage generating circuit 8 include the respective waveform adjusting sections. However, the present invention is not limited to this configuration. Alternatively, it is possible that only one of the first or second scan voltage generating circuit includes a waveform adjusting section.

Embodiment 2

Figure 9:
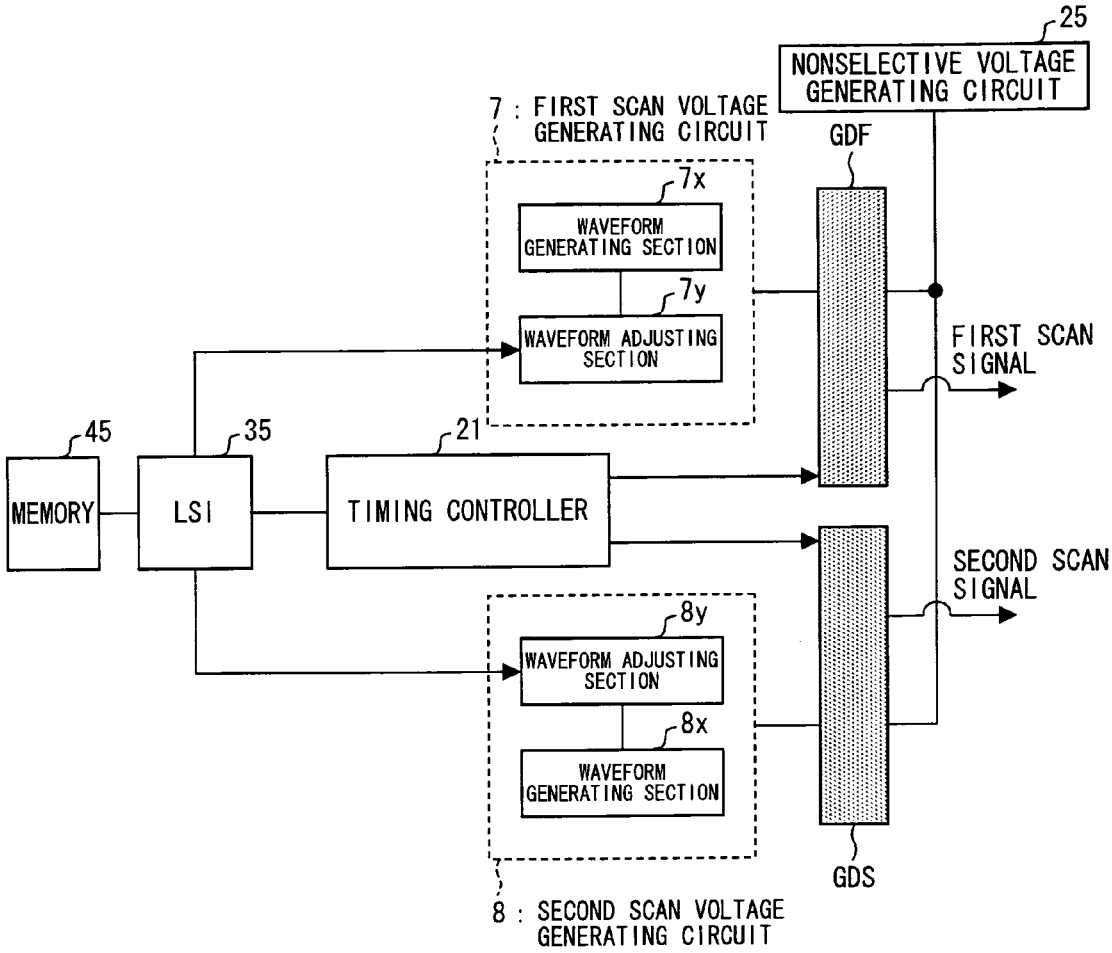
FIG. 9 is a block diagram illustrating a configuration (a configuration example of a driver control circuit shown in FIG. 1) according to Embodiment 2.

FIG. 9 is a block diagram illustrating a part of the driver control circuit 3 and first and second gate drivers GDF and GDS shown in FIG. 1. As shown in FIG. 9, the driver control circuit 3 includes: a constant-voltage regulated power supply 11; a nonselective voltage generating circuit 25; a memory 45; an LSI 35; a timing controller 21; a first scan voltage generating circuit 7; and a second scan voltage generating circuit 8. Note that the first scan voltage generating circuit 7 includes a waveform generating section 7*x* and a waveform adjusting section 7*y*, and the second scan voltage generating circuit 8 includes a waveform generating section 8*x* and a waveform adjusting section 8*y*.

The first scan voltage generating circuit 7 converts a constant voltage supplied from the constant-voltage regulated power supply 11 so that the converted voltage corresponds to the first region FA, and outputs to the first gate driver GDF, as a first scan voltage, the converted voltage. Moreover, the second scan voltage generating circuit 8 converts a constant voltage supplied from the constant-voltage regulated power supply 11 so that the converted voltage corresponds to the second region SA, and outputs to the second gate driver GDS, as a second scan voltage, the converted voltage. The timing controller 21 outputs a GCK (gate clock pulse) to each of the first and second gate drivers GDF and GDS. The LSI 35 controls the waveform adjusting sections 7*y* and 8*y* in accordance with data read out from the memory 45.

Then, the first gate driver GDF generates the first scan signal in accordance with (i) the first scan voltage supplied from the first scan voltage generating circuit 7, (ii) a nonselective voltage supplied from the nonselective voltage generating circuit 25, and (iii) a GCK supplied from the timing controller 21, and then sequentially outputs the first scan signal to the scan signal lines (GF1 through GFk) in the first region FA. The second gate driver GDS generates the second scan signal in accordance with (i) the second scan voltage supplied from the second scan voltage generating circuit 8, (ii) a nonselective voltage supplied from the nonselective voltage generating circuit 25, and (iii) a GCK supplied from the timing controller 21, and then sequentially outputs the second scan signal to the scan signal lines (GSk+1 through GSm) in the second region SA.

Figure 11:
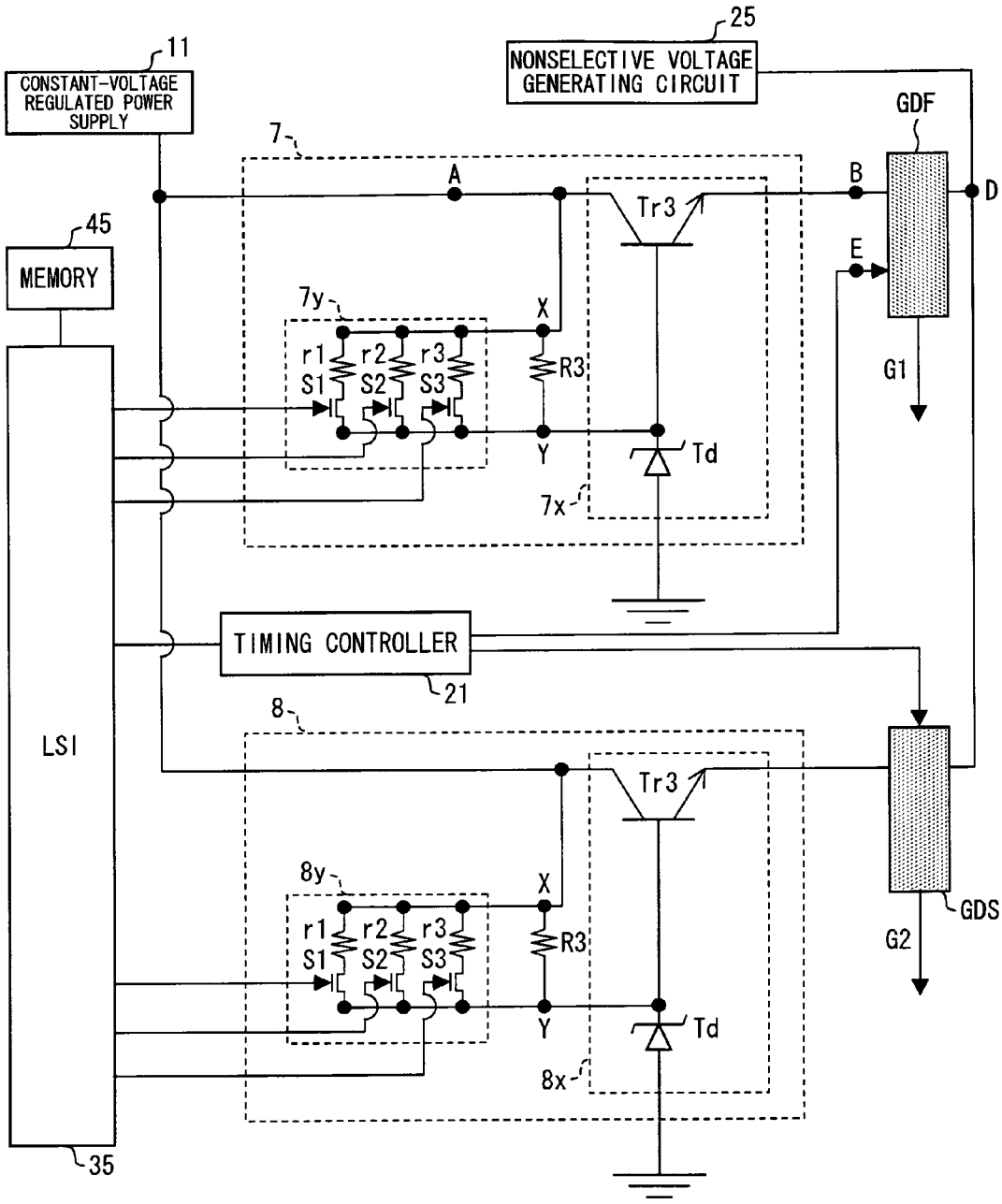
FIG. 11 is a circuit diagram illustrating another specific example of the configuration shown in FIG. 9.

FIG. 11 is a circuit diagram illustrating a specific example of the configuration shown in FIG. 9. As shown in FIG. 11, the waveform generating section 7*x* includes: a transistor Tr3 (third transistor) which is an NPN bipolar transistor; a resistor R3 (third resistor); and a zener diode Td. The transistor Tr3 has (i) a collector terminal connected to the constant-voltage regulated power supply 11 and (ii) an emitter terminal connected to the first gate driver GDF. The zener diode Td has (i) an anode terminal which is grounded and (ii) a cathode terminal connected to a base terminal of the transistor Tr3. The resistor R3 is provided between a node X and a node Y. The node X is connected to the collector terminal of the transistor Tr3 and the node Y is connected to the base terminal of the transistor Tr3. The waveform adjusting section 7*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, in the first scan voltage generating circuit 7, the waveform adjusting section 7*y* is provided in parallel with the resistor R3 which is provided between the collector terminal and the base terminal of the transistor Tr3. Note that the waveform generating section 8*x* and the waveform adjusting section 8*y* in the second scan voltage generating circuit 8 have respective same configurations as those of the waveform generating section 7*x* and the waveform adjusting section 7*y*, except that an emitter terminal of the transistor Tr3 of the waveform generating section 8*x* is connected to the second gate driver GDS.

Figure 12:
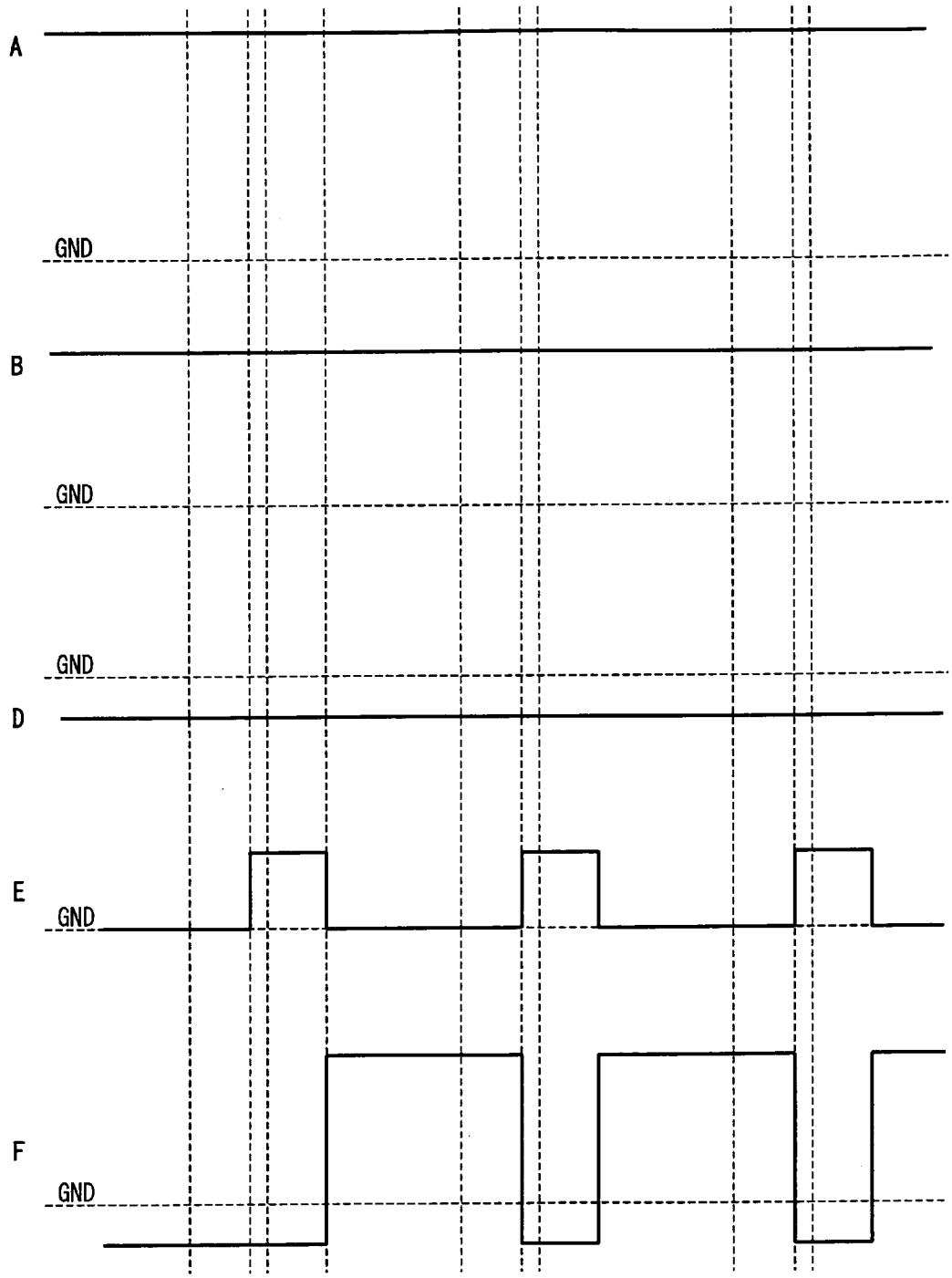
FIG. 12 is a timing chart illustrating waveforms of the components shown in FIG. 11.
Figure 13:
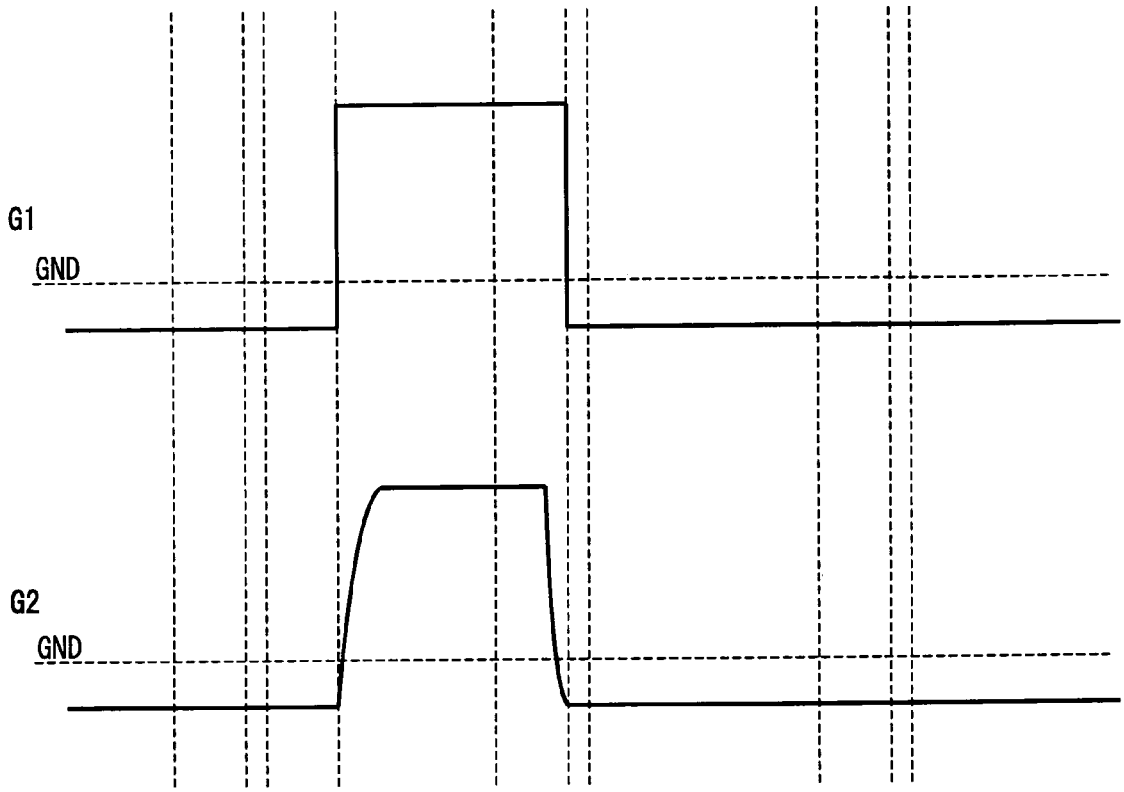
FIG. 13 is a graph illustrating waveforms of a first scan signal and a second scan signal in their active periods.
Figure 14:
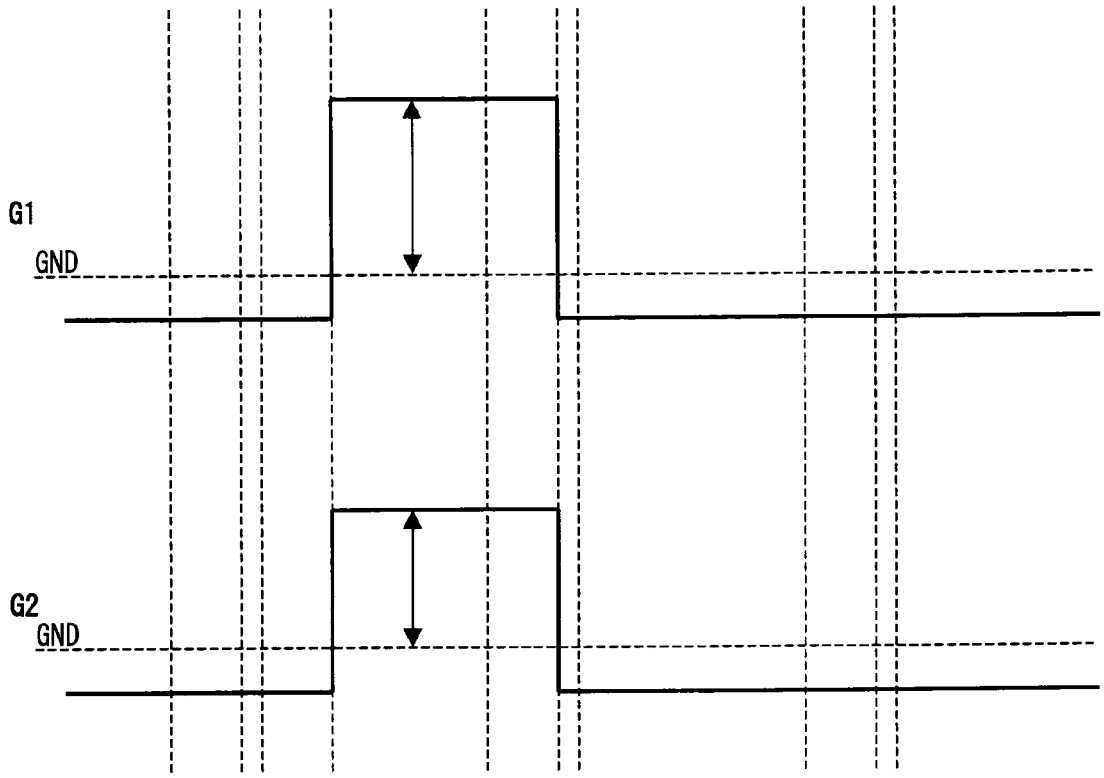
FIG. 14 is a graph illustrating waveforms of a first scan signal and a second scan signal in their active periods.

FIG. 12 illustrates waveforms of A, B, and D through F, where A is an output of the constant-voltage regulated power supply 11, B is an input to the first gate driver GDF, D is an output of the nonselective voltage generating circuit 25, E is an input (GCK) to the first gate driver GDF from the timing controller 21, and F is a voltage pulse generated at the first gate driver GDF.

The collector terminal of the transistor Tr3 receives an output A from the constant-voltage regulated power supply 11. The output A is reduced by the waveform generating section 7*x*, and then the output A thus reduced is supplied, as an input B, to the first gate driver GDF. The first gate driver GDF receives a constant voltage, which is less than a GND voltage represented by D, from the nonselective voltage generating circuit 25. Specifically, the first gate driver GDF selects a voltage (nonselective voltage) supplied from the nonselective voltage generating circuit 25 in a period during which an input E (GCK) of "H" is supplied from the timing controller 21. Whereas, in a period during which the GCK is "L", the first gate driver GDF selects a voltage (first scan voltage) supplied from the first scan voltage generating circuit 7. This leads to a generation of a voltage having a rectangular shape as shown by F in FIG. 12. Then, the first gate driver GDF sequentially outputs, to the scan signal lines (GF1 through GFk), a first scan signal (gate on pulse) in which such a voltage pulse rises in an active period of the first scan signal.

The waveform adjusting section 7*y* sets a resistance between the nodes X and Y in the first scan voltage generating circuit 7. Specifically, each of the transistors S1 through S3 is turned ON or OFF in accordance with a signal from the LSI 35. FIG. 5 shows patterns (patterns 1 through 8) of the combinations of ON and OFF of the transistors S1 through S3.

In a case where the resistance between the nodes X and Y is changed, a base current of the transistor Tr3 is changed. This causes a change in steepness (degree of blunting) of rising and falling edges of the voltage pulse. Accordingly, for example, in a case where luminance becomes higher in the second region SA than in the first region FA while displays of an identical tone are being carried out, it is only necessary that the second scan signal G2, which is outputted from the second gate driver GDS, has rising and falling edges which blunt further than those of the first scan signal G1 which is outputted from the first gate driver GDF (see FIG. 13). This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set.

Figure 15:
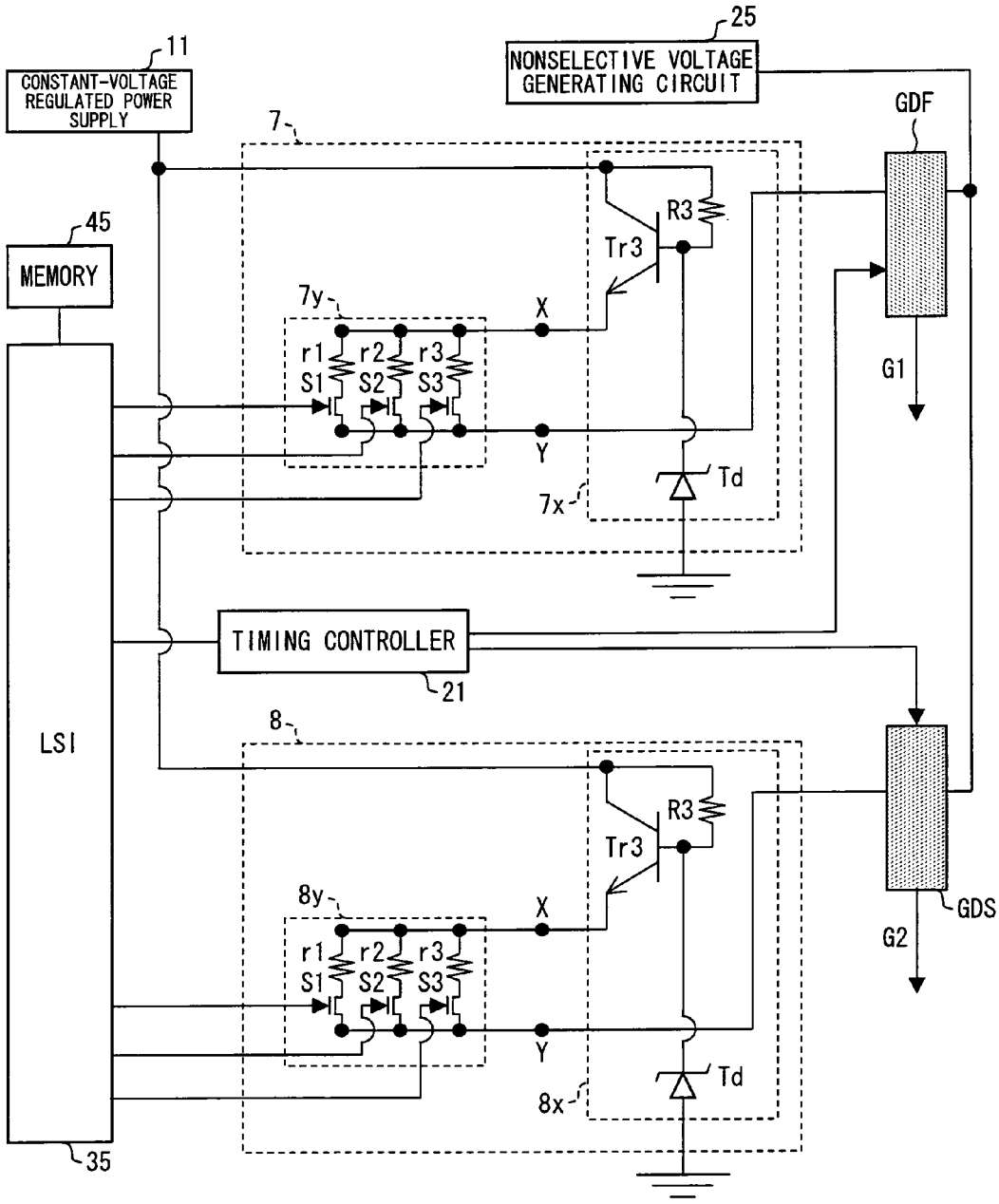
FIG. 15 is a circuit diagram illustrating another specific example of the configuration shown in FIG. 9.

FIG. 15 is a circuit diagram illustrating another specific example of the configuration shown in FIG. 9. As shown in FIG. 15, the waveform generating section 7*x* includes a transistor Tr3 which is an NPN bipolar transistor; a resistor R3; and a zener diode Td. The transistor Tr3 has (i) a collector terminal connected to the constant-voltage regulated power supply 11 and (ii) an emitter terminal connected to a node X. The zener diode Td has (i) an anode terminal which is grounded and (ii) a cathode terminal connected to a base terminal of the transistor Tr3. The resistor R3 is provided between the collector terminal of the transistor Tr3 and the base terminal of the transistor Tr3. The node X is connected to the emitter terminal of the transistor Tr3, and the node Y is connected to the first gate driver GDF. The waveform adjusting section 7*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, in the first scan voltage generating circuit 7, the waveform adjusting section 7*y* is provided between the emitter terminal of the transistor Tr3 and the first gate driver GDF. Note that the waveform generating section 8*x* and the waveform adjusting section 8*y* in the second scan voltage generating circuit 8 have respective same configurations as those of the waveform generating section 7*x* and the waveform adjusting section 7*y*, except that an emitter terminal of the transistor Tr3 of the waveform generating section 8*x* is connected to the second gate driver GDS.

According to the configuration shown in FIG. 15, in a case where the resistance (value of dumping resistance) between the nodes X and Y is changed, the degree of blunting of rising and falling edges of the voltage pulse is changed. Accordingly, for example, in a case where luminance becomes higher in the second region SA than in the first region FA while displays of an identical tone are being carried out, it is only necessary that the second scan signal G2, which is outputted from the second gate driver GDS, has rising and falling edges which blunt further than those of the first scan signal G1 which is outputted from the first gate driver GDF. This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set.

Figure 16:
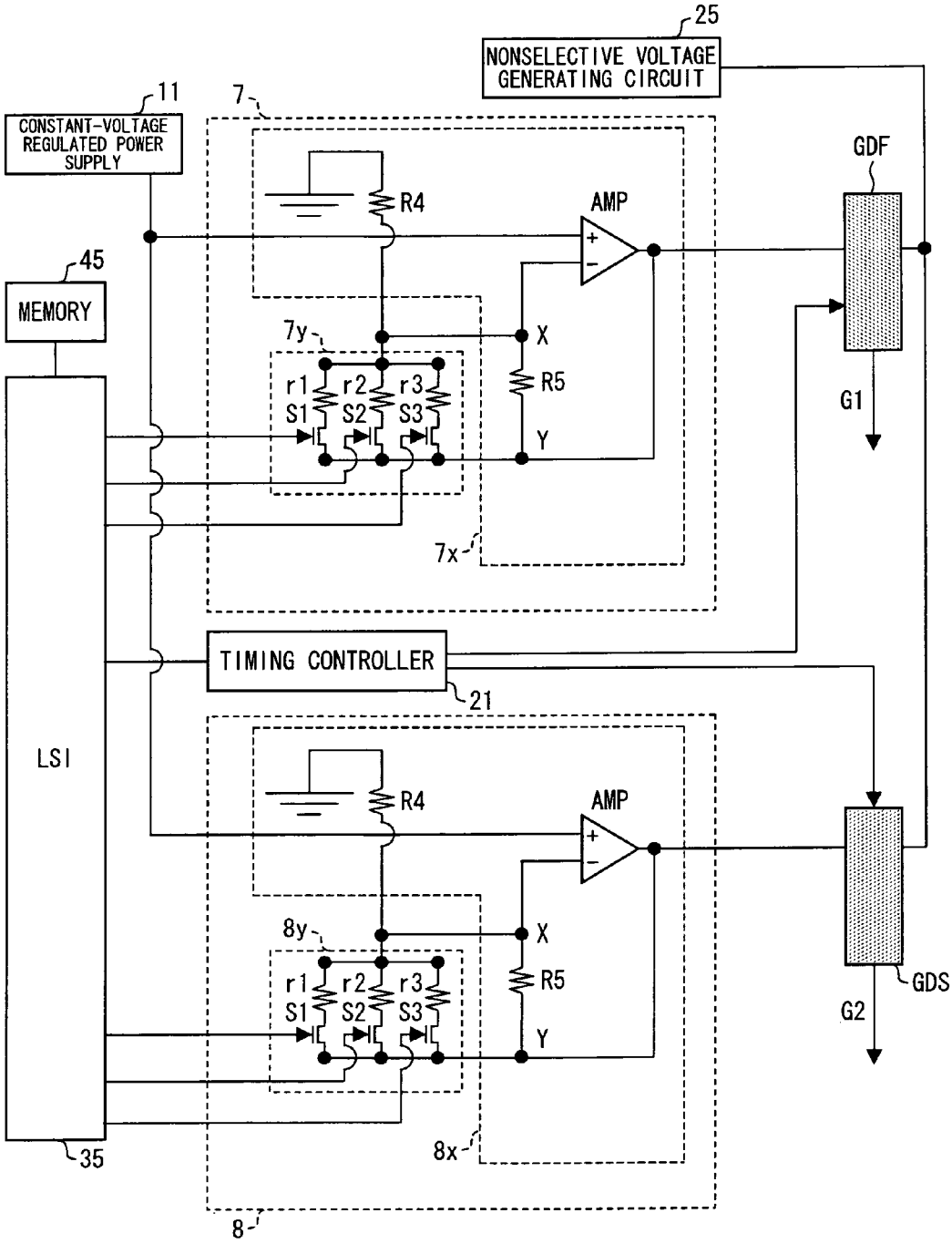
FIG. 16 is a circuit diagram illustrating another specific example of the configuration shown in FIG. 9.

FIG. 16 is a circuit diagram illustrating a further specific example of the configuration shown in FIG. 9. As shown in FIG. 16, the waveform generating section 7*x* includes an amplifier (circuit) AMP and resistors R4 and R5 (fourth and fifth resistors). The amplifier AMP has (i) an output terminal connected to the first gate driver GDF, (ii) a non-inverted (positive phase) input terminal connected to the constant-voltage regulated power supply 11, and (iii) an inverted (negative phase) input terminal connected to a node X. The resistor R4 is provided between ground and the node X. The resistor R5 is provided between the output terminal of the amplifier AMP and the node X. The waveform adjusting section 7*y* includes three resistors r1 through r3, and three transistors S1 through S3. More specifically, the resistors r1 through r3 are connected in series with the three transistors S1 through S3, respectively, in this order. The series-connected r1 and S1, the series-connected r2 and S2, and the series-connected r3 and S3 are connected in parallel with each other, and (i) one ends of the resistors r1 through r3 are connected to the node X and (ii) one ends of the transistors S1 through S3 are connected to the node Y. Gate terminals of the respective transistors S1 through S3 are connected to the LSI 35. That is, according to the first scan voltage generating circuit 7, the waveform adjusting section 7*y* is provided between the inverted input terminal and the output terminal of the amplifier AMP. Note that the waveform generating section 8*x* and the waveform adjusting section 8*y* in the second scan voltage generating circuit 8 have respective same configurations as those of the waveform generating section 7*x* and the waveform adjusting section 7*y*, except that an output terminal of the amplifier AMP in the waveform generating section 8*x* is connected to the second gate driver GDS.

The waveform adjusting section 7*y* sets a resistance between the nodes X and Y in the first scan voltage generating circuit 7. Specifically, each of the transistors S1 through S3 is turned ON or OFF in accordance with a signal from the LSI 35. FIG. 5 illustrates patterns (patterns 1 through 8) of combinations of ON and OFF of the transistors S1 through S3.

In a case where the resistance between the nodes X and Y is changed, a height of the voltage pulse (voltage value) is changed. Accordingly, for example, in a case where luminance becomes higher in the second region SA than in the first region FA while displays of an identical tone are being carried out, it is only necessary that the second scan signal G2 in its active period takes a voltage value smaller than that of the first scan signal G1 in its active period (see FIG. 14). This allows pattern settings (settings ON/OFF of S1 through S3) of the waveform adjusting section 7*y* and the waveform adjusting section 8*y* to be carried out. More specifically, the memory 45 stores adjusting data in advance, and the LSI 35 outputs, in accordance with the adjusting data, signals to the respective waveform adjusting sections 7*y* and 8*y*. This causes the patterns to be set.

Figure 26:
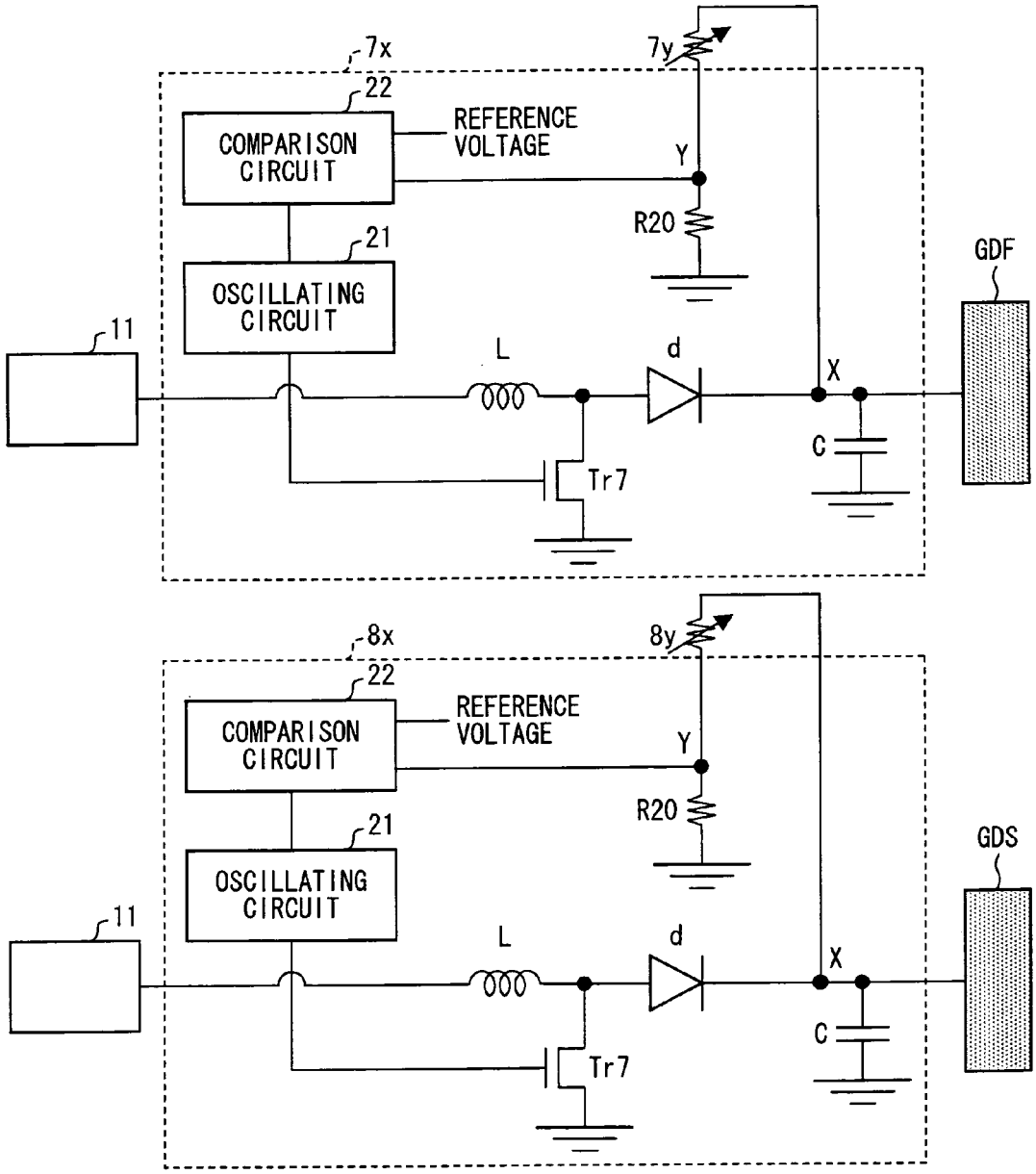
FIG. 26 is a circuit diagram illustrating another configuration (a configuration example of a driver control circuit shown in FIG. 1) according to Embodiment 2.

In the present embodiment, the waveform adjusting sections 7*y* and 8*y* and the waveform generating sections 7*x* and 8*x* can be configured as shown in FIG. 26. In FIG. 26, the waveform generating section 7*x* is a switching regulator which includes: a comparison circuit 22; an oscillating circuit 21; a transistor Tr7, a coil L, a diode d, a capacitor C, and a resistor R20. Note that the coil L is provided between the constant-voltage regulated power supply 11 and a drain terminal of the transistor Tr7. The diode d has (i) an anode terminal connected to the drain terminal of the transistor Tr7 and (ii) a cathode terminal connected to one of electrodes of the capacitor C, and the other of the electrodes of the capacity C is grounded. Moreover, the comparison circuit 22 has an output terminal connected to the oscillating circuit 21. The oscillating circuit 21 is connected to a gate terminal of the transistor Tr7. The first gate driver GDF is connected to the cathode terminal of the diode d. The resistor R20 is provided between ground and a node Y. The node Y is connected to the comparison circuit 22 (input terminal), and the comparison circuit receives a reference voltage. Further, the waveform adjusting section 7*y* is provided between the node Y and the node X which is connected to the first gate driver GDF. Note that the waveform adjusting section 7*y* shown in FIG. 26 has a configuration identical to that of the waveform adjusting section 7*y* shown in FIG. 16. The waveform generating section 8*x* and the waveform adjusting section 8*y* in the second scan voltage generating circuit 8 have respective same configurations as those of the waveform generating section 7*x* and the waveform adjusting section 7*y*, except that the node X in the waveform generating section 8*x* is connected to the second gate driver GDS.

In a case where the resistance between the nodes X and Y is changed, a height of the voltage pulse (voltage value) is changed. Accordingly, for example, in a case where luminance becomes higher in the second region SA than in the first region FA while displays of an identical tone are being carried out, it is only necessary that the second scan signal G2 in its active period takes a voltage value smaller than a voltage value of the first scan signal G1 in its active period (see FIG. 14). This allows pattern settings (settings ON/OFF of S1 through S3) of the waveform adjusting section 7y and the waveform adjusting section 8y to be carried out. More specifically, the memory stores adjusting data in advance, and the LSI 35 outputs, in accordance with the adjusting data, signals to the respective waveform adjusting sections 7y and 8y. This causes the patterns to be set.

In the present embodiment, the first scan voltage generating circuit 7 and the second scan voltage generating circuit 8 includes the respective waveform adjusting sections. However, the present invention is not limited to the configuration. Alternatively, it is possible that only one of the first or second scan voltage generating circuit includes the waveform adjusting section.

Embodiment 3

Figure 10:
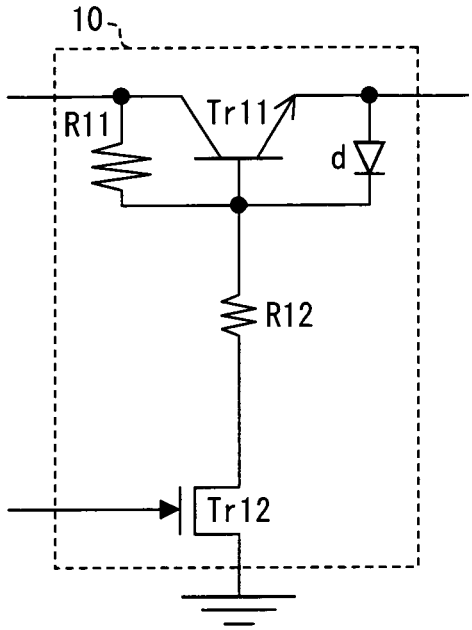
FIG. 10 is a circuit diagram illustrating a configuration of a subsequent stage circuit.
Figure 17:
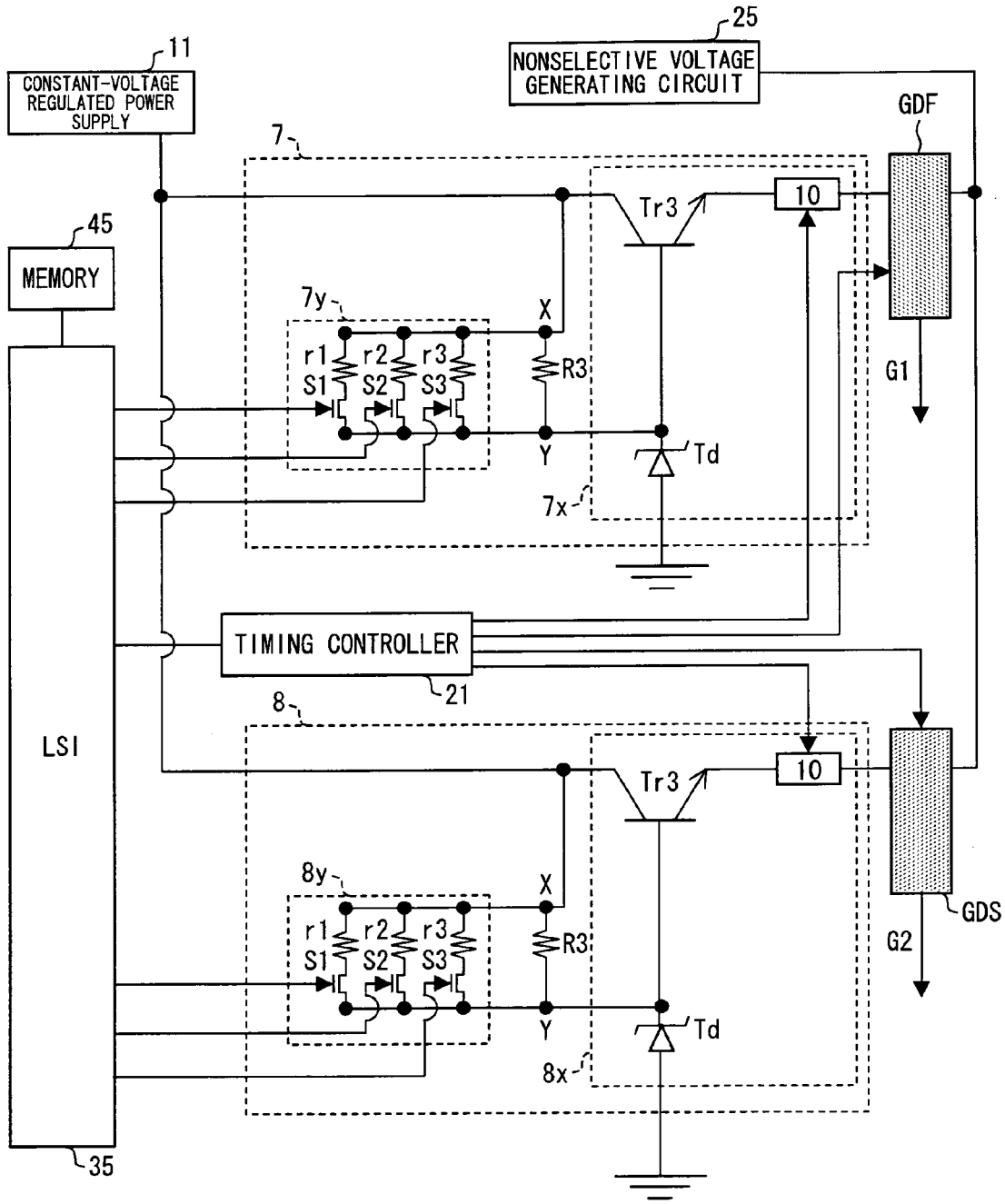
FIG. 17 is a circuit diagram illustrating a configuration (a configuration example of a driver control circuit shown in FIG. 1) according to Embodiment 3.

In the present embodiment, as shown in FIG. 17, (i) a subsequent stage circuit 10 shown in FIG. 10 is provided so as to follow the waveform generating section 7x shown in FIG. 11 and a subsequent stage circuit 10 shown in FIG. 10 is provided so as to follow the waveform generating section 8x shown in FIG. 11. That is, the subsequent stage circuit 10 is provided between the first gate driver GDF and an emitter terminal of the transistor Tr3, and the another subsequent stage circuit 10 is provided between the second gate driver GDS and an emitter terminal of the transistor Tr3. Note that each of the subsequent stage circuits 10 includes: a transistor Tr11 which is an NPN bipolar transistor; resistors R11 and R12; a diode d; and a transistor Tr12 which is an N-channel FET. The transistor Tr12 has a source terminal which is grounded. The resistor R11 is provided between a collector terminal of the transistor Tr11 and a base terminal of the transistor Tr11. The diode d has (i) an anode terminal connected to the emitter terminal of the transistor Tr11 and (ii) a cathode terminal connected to the base terminal of the transistor Tr11. The resistor R12 is provided between the base terminal of the transistor Tr11 and a drain terminal of the transistor Tr12. According to the configuration shown in FIG. 17, the emitter terminal of the transistor Tr11 shown in FIG. 10 is connected to the first gate driver GDF (second gate driver GDS), and the collector terminal of the transistor Tr11 is connected to the emitter terminal of the transistor Tr3. The gate terminal of the transistor Tr12 shown in FIG. 10 is connected to the timing controller 21. According to the configuration shown in FIG. 17, the waveform adjusting sections 7y and 8y can have resistances which are different from each other. This allows the first scan signal G1 to have a waveform, during its active period, which is different from that of the second scan signal G2.

Figure 18:
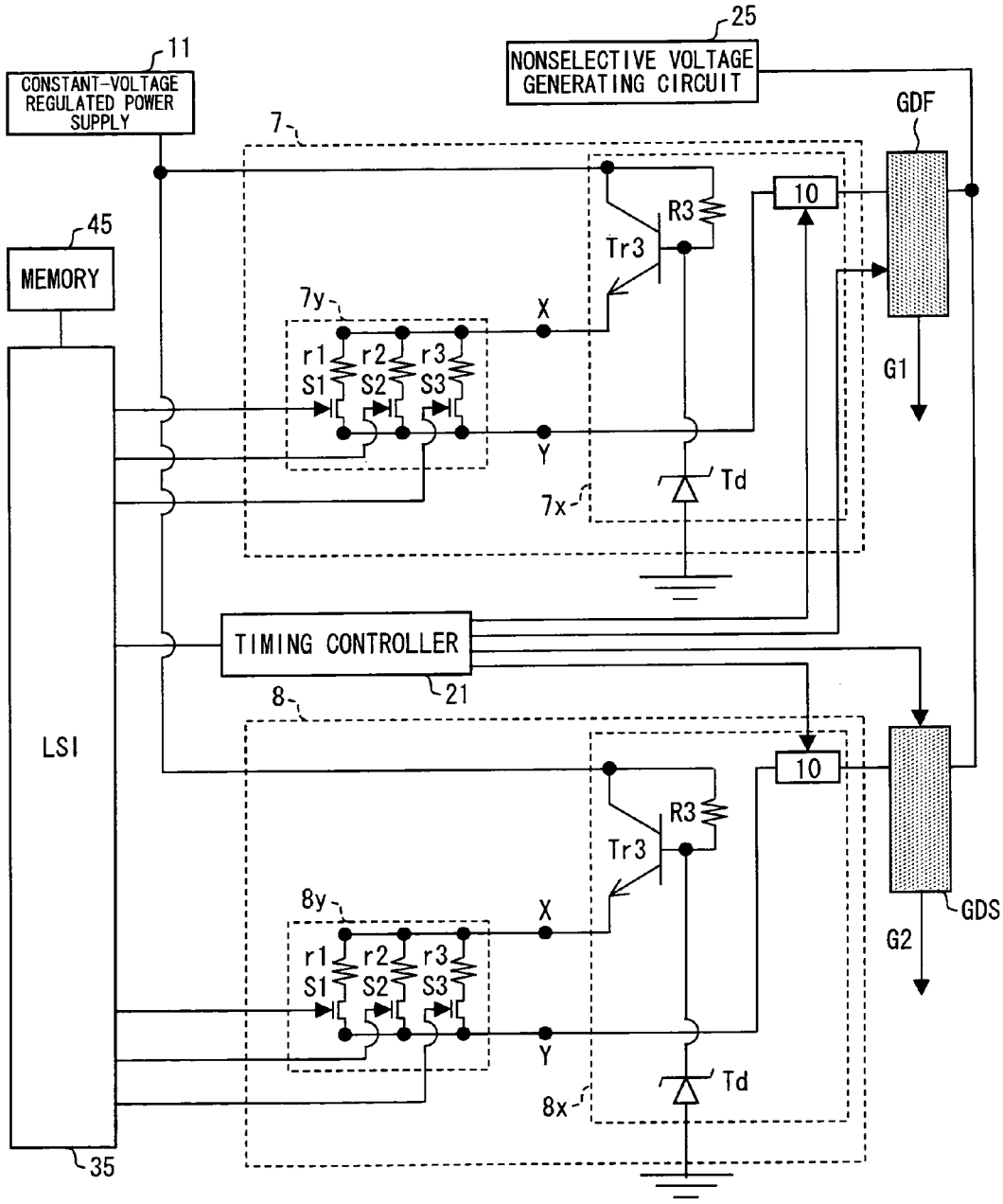
FIG. 18 is a circuit diagram illustrating another configuration according to Embodiment 3.

Moreover, in the present embodiment, as shown in FIG. 18, (i) a subsequent stage circuit 10 shown in FIG. 10 can be provided so as to follow the waveform generating section 7x shown in FIG. 15 and a subsequent stage circuit 10 shown in FIG. 10 can be provided so as to follow the waveform generating section 8x shown in FIG. 15. That is, the subsequent stage circuit 10 is provided between the first gate driver GDF and the node Y, and the another subsequent stage circuit 10 is provided between the second gate driver GDS and the node Y. According to the configuration shown in FIG. 18, an emitter terminal of the transistor Tr11 shown in FIG. 10 is connected to the first gate driver GDF (second gate driver GDS), the collector terminal of the transistor Tr11 is connected to the node Y, and the gate terminal of the transistor Tr12 shown in FIG. 10 is connected to the timing controller 21. According to the configuration shown in FIG. 18, the waveform adjusting sections 7y and 8y can have resistances which are different from each other. This allows first scan signal G1 to have a waveform, during its active period, which is different from that of the second scan signal G2.

Figure 19:
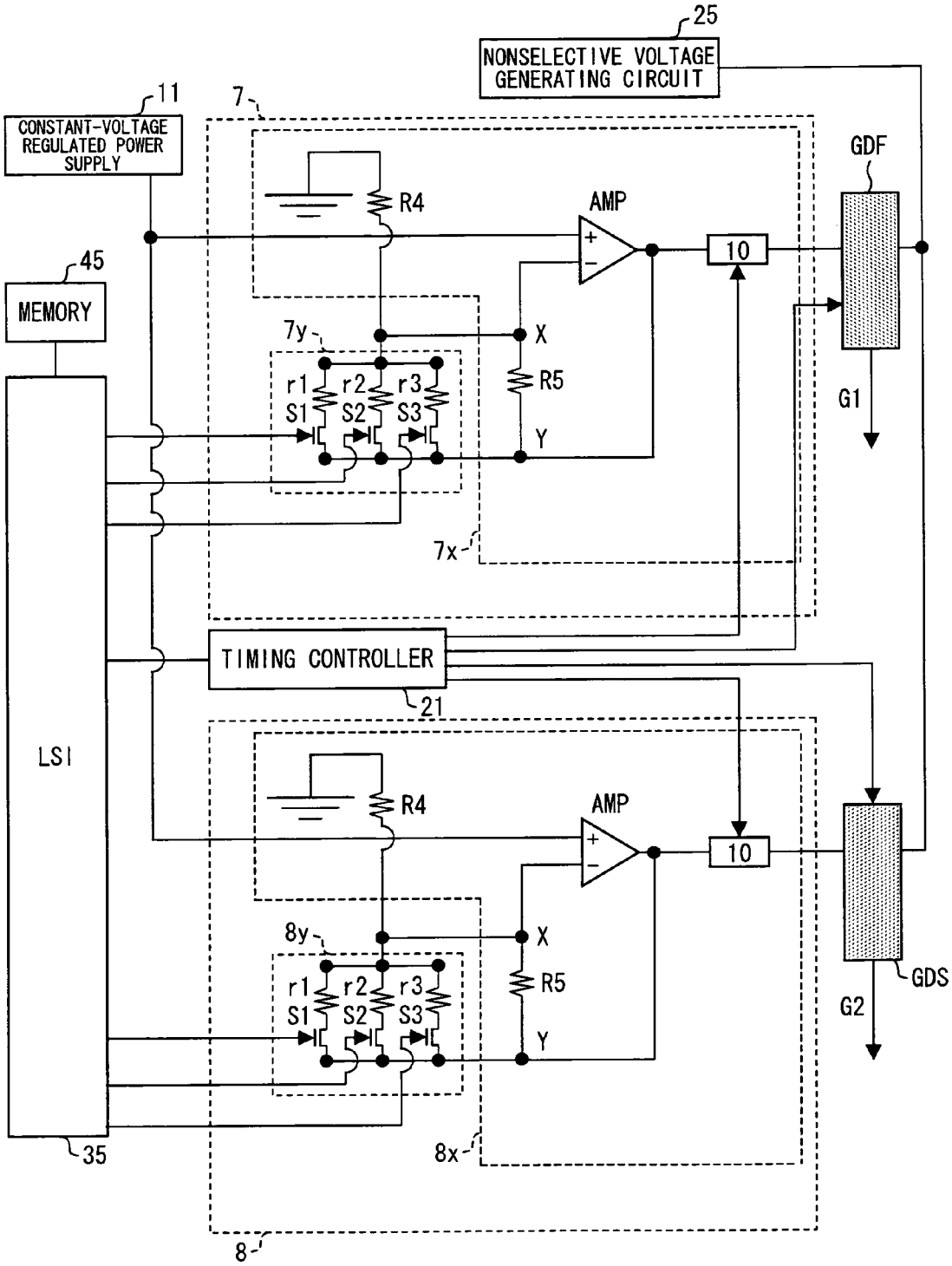
FIG. 19 is a circuit diagram illustrating another configuration according to Embodiment 3.

Moreover, in the present embodiment, as shown in FIG. 19, (i) a subsequent stage circuit 10 shown in FIG. 10 can be provided so as to follow the waveform generating section 7x shown in FIG. 16 and a subsequent stage circuit 10 shown in FIG. 10 can be provided so as to follow the waveform generating section 8x shown in FIG. 16. That is, the subsequent stage circuit 10 is provided between the first gate driver GDF and the output terminal of the amplifier AMP, and the another subsequent stage circuit 10 is provided between the second gate driver GDS and the output terminal of the amplifier AMP. According to the configuration shown in FIG. 19, the emitter terminal of the transistor Tr11 shown in FIG. 10 is connected to the first gate driver GDF (second gate driver GDS), and the collector terminal of the transistor Tr11 is connected to the output terminal of the amplifier AMP. The gate terminal of the transistor Tr12 shown in FIG. 10 is connected to the timing controller 21. According to the configuration shown in FIG. 19, the waveform adjusting sections 7y and 8y can have resistances which are different from each other. This allows the first scan signal G1 to have a waveform, during its active period, which is different from that of the second scan signal G2. Note that a pulse signal can be supplied from the timing controller to the gate terminal of the transistor Tr12 in the subsequent stage circuit 10, via the LSI 35.

Embodiment 4

Figure 20:
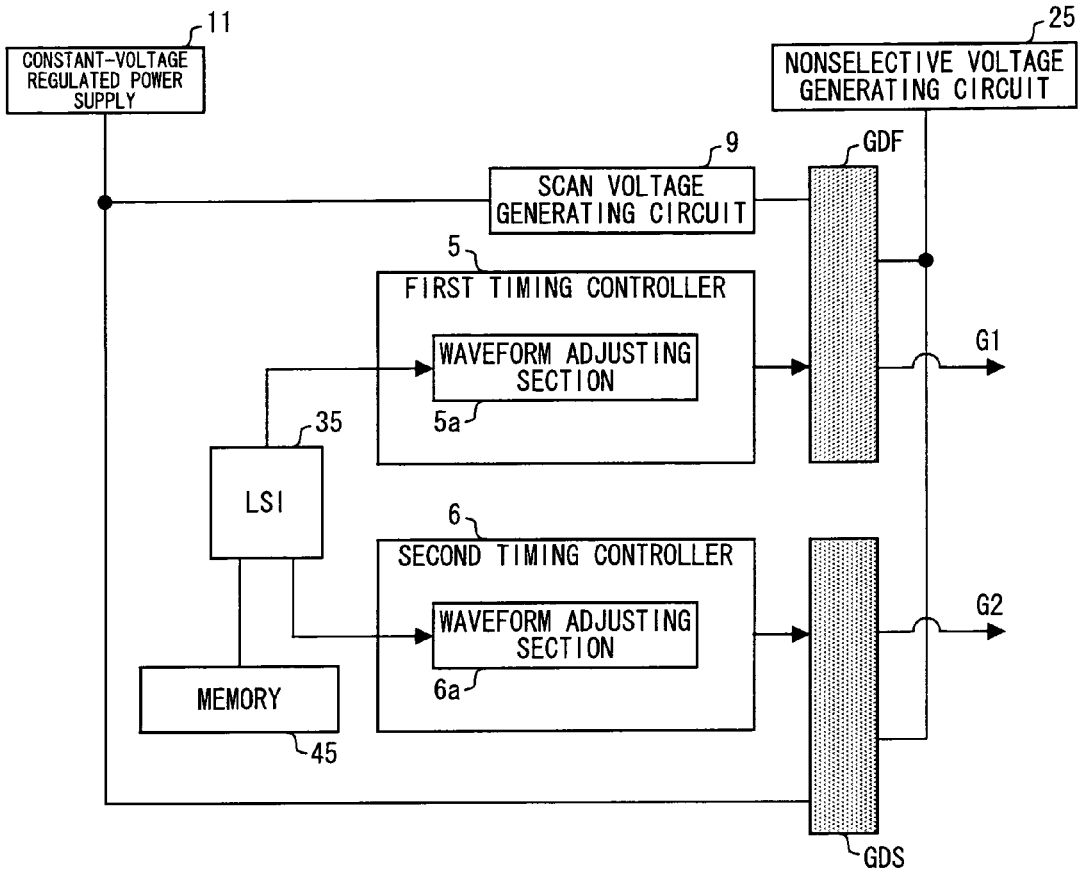
FIG. 20 is a block diagram illustrating a configuration (a configuration example of a driver control circuit shown in FIG. 1) according to Embodiment 4.

FIG. 20 is a block diagram illustrating a part of the driver control circuit 3 and the first and second gate drivers GDF and GDS shown in FIG. 1. As shown in FIG. 20, the driver control circuit 3 includes: a constant-voltage regulated power supply 11; a nonselective voltage generating circuit 25; a memory 45; an LSI 35; a scan voltage generating circuit 9; a first timing controller 5; and a second timing controller 6. The first timing controller 5 includes a waveform adjusting section 5a, and the second timing controller 6 includes a waveform adjusting section 6a.

The scan voltage generating circuit 9 generates a scan voltage with the use of a constant voltage supplied from the constant-voltage regulated power supply 11, and then outputs the scan voltage to the first gate driver GDF and the second gate driver GDS. The first timing controller 5 generates a first GCK (gate clock) which corresponds to the first region FA, and then outputs the first GCK to the first gate driver GDF. The second timing controller 6 generates a second GCK (gate clock) which corresponds to the second region SA, and then outputs the second GCK to the second gate driver GDS. The LSI 35 controls the waveform adjusting sections 5a and 6a in accordance with data read out from the memory 45.

The first gate driver GDF generates the first scan signal G1 in accordance with the scan voltage supplied from the scan voltage generating circuit 9, a nonselective voltage supplied from the nonselective voltage generating circuit 25, and the first GCK supplied from the first timing controller 5, and then sequentially outputs the first scan signal G1 to the scan signal lines (GF1 through GFk) in the first region FA. Moreover, the second gate driver GDS generates the second scan signal G2 in accordance with the scan voltage supplied from the scan voltage generating circuit 9, a nonselective voltage supplied from the nonselective voltage generating circuit 25, and the second GCK supplied from the second timing controller 6, and then sequentially outputs the second scan signal G2 to the scan signal lines (GSk+1 through GSm) in the second region SA.

Figure 22:
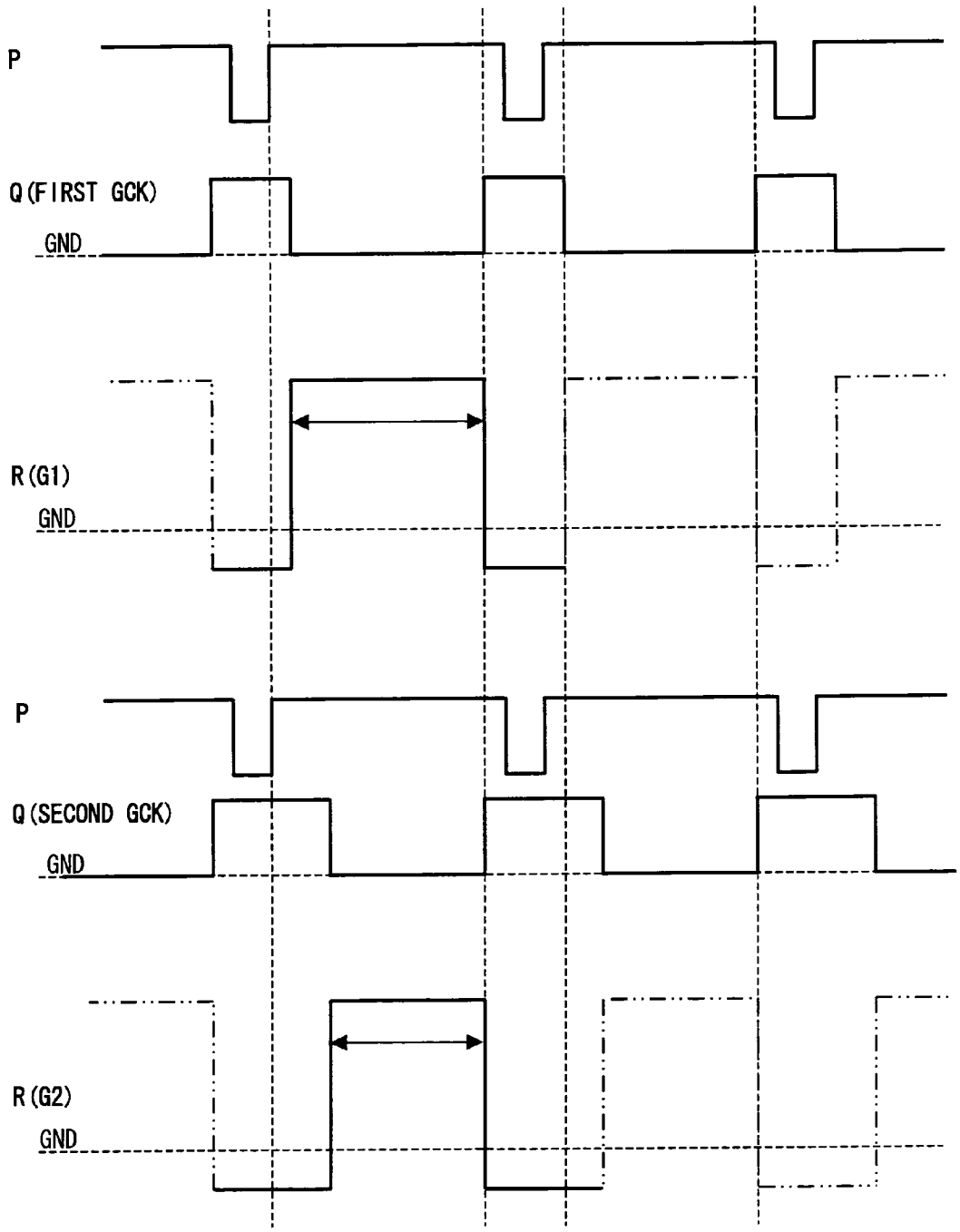
FIG. 22 is a timing chart illustrating waveforms of an output of a data signal, a first GCK, a first scan signal, a second GCK, and a second scan signal.

FIG. 22 shows each of waveforms P through R, where: P is a data signal; Q is a signal (first GCK) supplied to the first gate driver GDF from the first timing controller 5; and R is a voltage pulse signal (a waveform of the first scan signal G1 during its active period) generated by the first gate driver GDF. The first gate driver GDF selects a voltage (nonselective voltage) supplied from the nonselective voltage generating circuit 25 while an input signal (first GCK) of "H" is being supplied from the first timing controller 5. Whereas, while the first GCK of "L" is being supplied, the first gate driver GDF selects a voltage (scan voltage) supplied from the scan voltage generating circuit 9. This leads to a generation of a voltage pulse having a rectangular shape as shown by R. Then, the first gate driver GDF outputs, to the scan signal lines (GF1 through GFk), a first scan signal G1 (gate on pulse signal) in which such a voltage pulse rises in an active period of the first scan signal G1.

The waveform adjusting section 5*a* adjusts a waveform of the first GCK, and the waveform adjusting section 6*a* adjusts a waveform of the second GCK. For example, as shown in FIG. 22, the first GCK and the second GCK have respective pulse signals (i) which rise at a same timing and (ii) whose widths are different from each other. This allows a width of an active period of the first scan signal G1 to be different from that of the second scan signal G2.

Accordingly, for example, in a case where luminance becomes higher in the second region SA than in the first region FA while displays of an identical tone are being carried out, it is only necessary that the width of the active period of the second scan signal G2 becomes shorter than the width of the active period of the first scan signal G1 (see FIG. 22). This allows the waveform adjusting section 5*a* and the waveform adjusting section 6*a* to be controlled. More specifically, the memory 45 stores adjusting data in advance, and the LSI 35 outputs, in accordance with the adjusting data, signals to the respective waveform adjusting sections 5*a* and 6*a*. This causes the setting to be carried out. Note that the adjusting data is preferable to be set for each panel.

Figure 27:
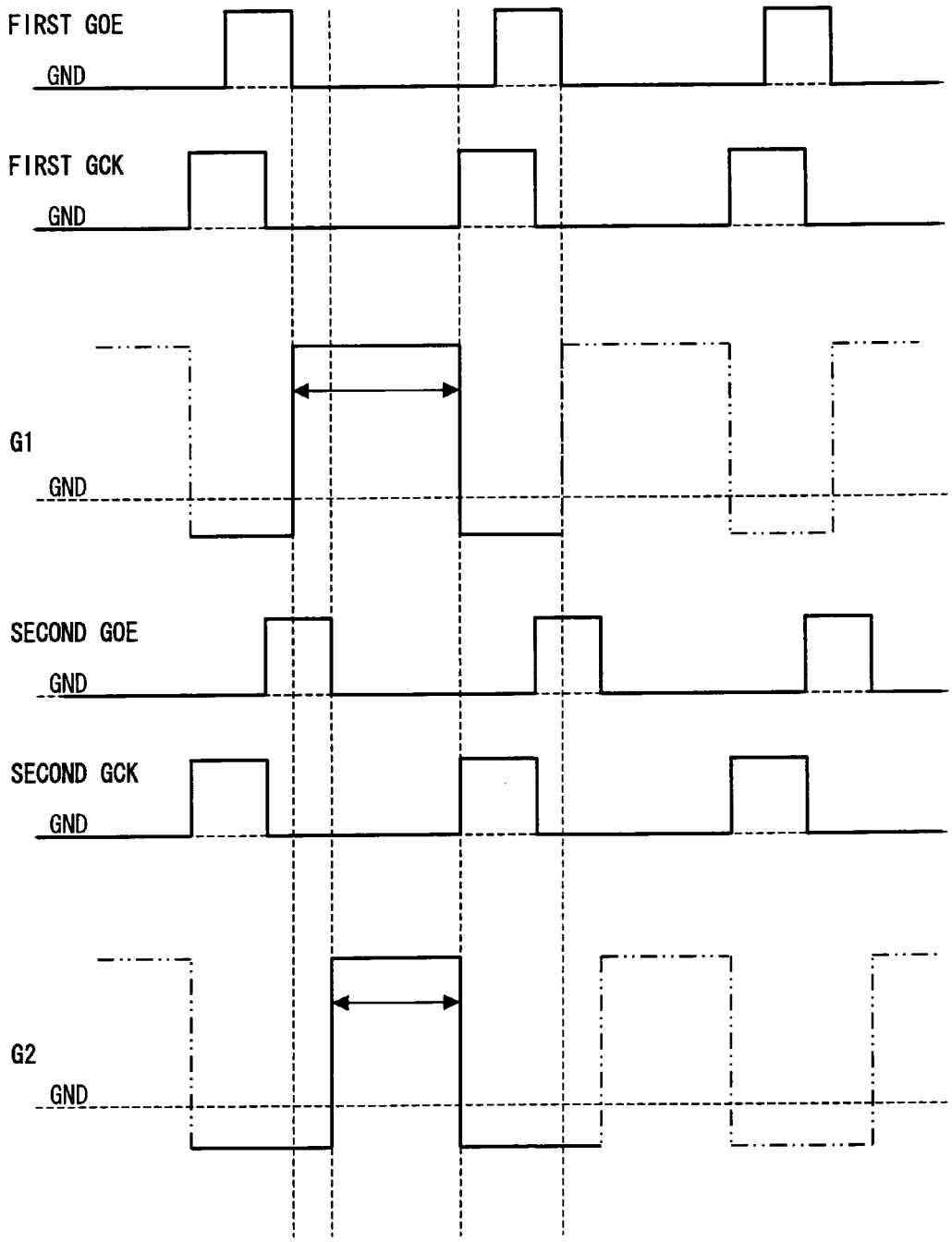
FIG. 27 is a timing chart illustrating waveforms of a first GOE, a first GCK, a first scan signal, a second GOE, a second GCK, and a second scan signal.

According to the configuration, the timing controllers (5 and 6) generate the first GCK and the second GCK, respectively. However, the present invention is not limited to this. For example, as shown in FIG. 27, it is possible that (i) the first timing controller 5 generates the first GCK and a first GOE, (ii) the second timing controller 6 generates the second GCK and the second GOE, and (iii) the first GOE and the second GOE are set to have respective different phases. This causes the first scan signal G1 to have a width of the active period which is different from that of the second scan signal G2.

Figure 24:
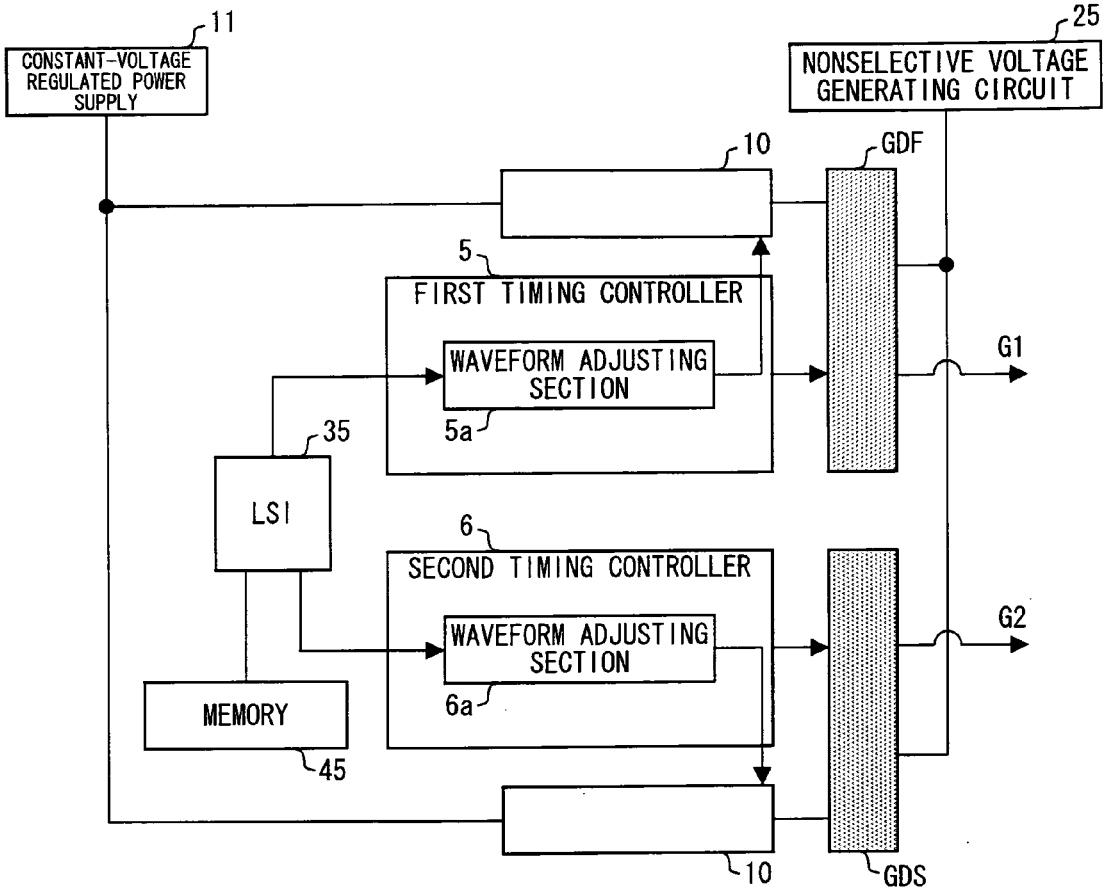
FIG. 24 is a block diagram illustrating another configuration (a configuration example of a driver control circuit shown in FIG. 1) according to Embodiment 4.
Figure 25:
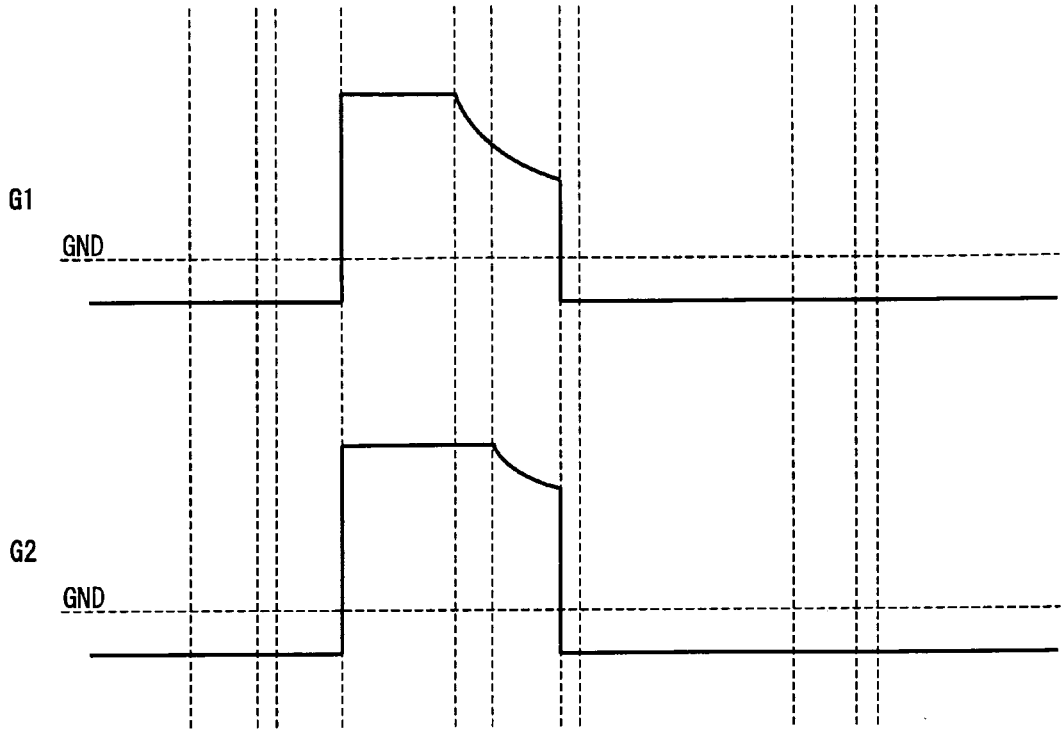
FIG. 25 is a graph illustrating waveforms of a first scan signal and a second scan signal in their active periods.

Further, in the present embodiment, it is possible that, as shown in FIG. 24, two subsequent stage circuits 10 shown in FIG. 10, which are connected to the respective waveform adjusting sections 5*a* and 6*a* are provided, instead of the scan voltage generating circuit 9 shown in FIG. 20. According to the configuration, the first scan signal G1 has a slope falling edge as shown in FIG. 25. In a case where the waveform adjusting section 5*a* (the waveform adjusting section 6*a*) adjusts the waveform of a pulse signal supplied to the gate terminal of the transistor Tr12 shown in FIG. 10, the first scan signal G1 has a start timing of the falling edge which is different from the second scan signal G2, as shown in FIG. 25. This allows the first scan signal G1 to have a waveform, during an active period, which is different from that of the second scan signal G2.

In the present embodiment, the first timing controller and the second timing controller 6 include the respectively waveform adjusting sections. However, the present invention is not limited to the configuration. It is possible that only one of the first timing controller 5 or the second timing controller 6 includes the waveform adjusting section.

Embodiment 5

Figure 21:
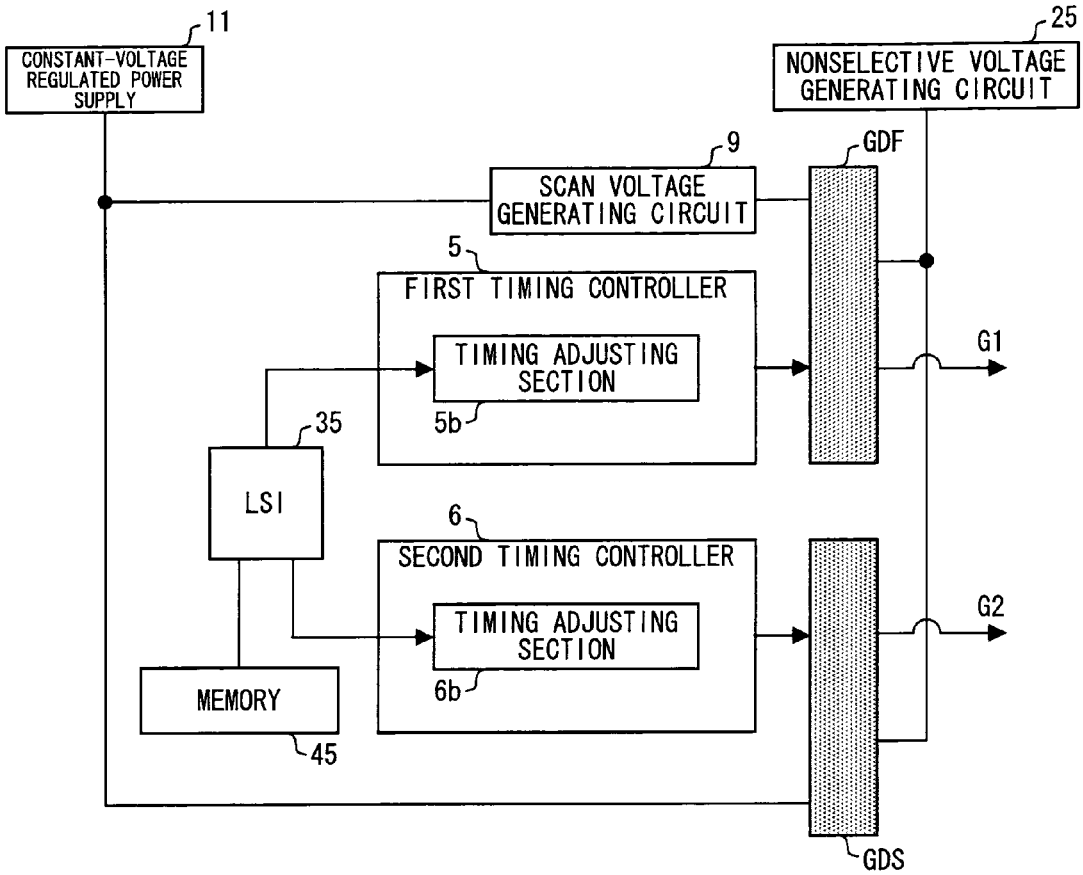
FIG. 21 is a block diagram illustrating a configuration (a configuration example of a driver control circuit shown in FIG. 1) according to Embodiment 5.

FIG. 21 is a block diagram illustrating a part of the driver control circuit 3 and the first and second gate drivers GDF and GDS shown in FIG. 1. As shown in FIG. 21, the driver control circuit 3 includes: a constant-voltage regulated power supply 11; a nonselective voltage generating circuit 25; a memory 45; an LSI 35 (timing adjusting section controlling circuit); a scan voltage generating circuit 9; a first timing controller 5; and a second timing controller 6. The first timing controller 5 includes a timing adjusting section 5*b*, and the second timing controller 6 includes a timing adjusting section 6*b*.

The scan voltage generating circuit 9 generates a scan voltage in accordance with a constant voltage supplied from the constant-voltage regulated power supply 11, and then sequentially outputs the scan voltage to the first gate driver GDF and the second gate driver GDS. The first timing controller 5 generates a first GCK (gate clock) which corresponds to the first region FA, and then outputs the first GCK to the first gate driver GDF. The second timing controller 6 generates a second GCK (gate clock) which corresponds to the second region SA, and then outputs the second GCK to the second gate driver GDS. The LSI 35 controls the timing adjusting sections 5*b* and 6*b* in accordance with data read out from the memory 45.

The first gate driver GDF generates the first scan signal in accordance with the scan voltage supplied from the scan voltage generating circuit 9, a nonselective voltage supplied from the nonselective voltage generating circuit 25, and the first GCK supplied from the first timing controller 5, and then sequentially outputs the first scan signal to the scan signal lines (GF1 through GFk) in the first region FA. Moreover, the second gate driver GDS generates the second scan signal in accordance with the scan voltage supplied from the scan voltage generating circuit 9, a nonselective voltage supplied from the nonselective voltage generating circuit 25, and the second GCK supplied from the second timing controller 6, and then sequentially outputs the second scan signal to the scan signal lines (GSk+1 through GSm) in the second region SA.

Figure 23:
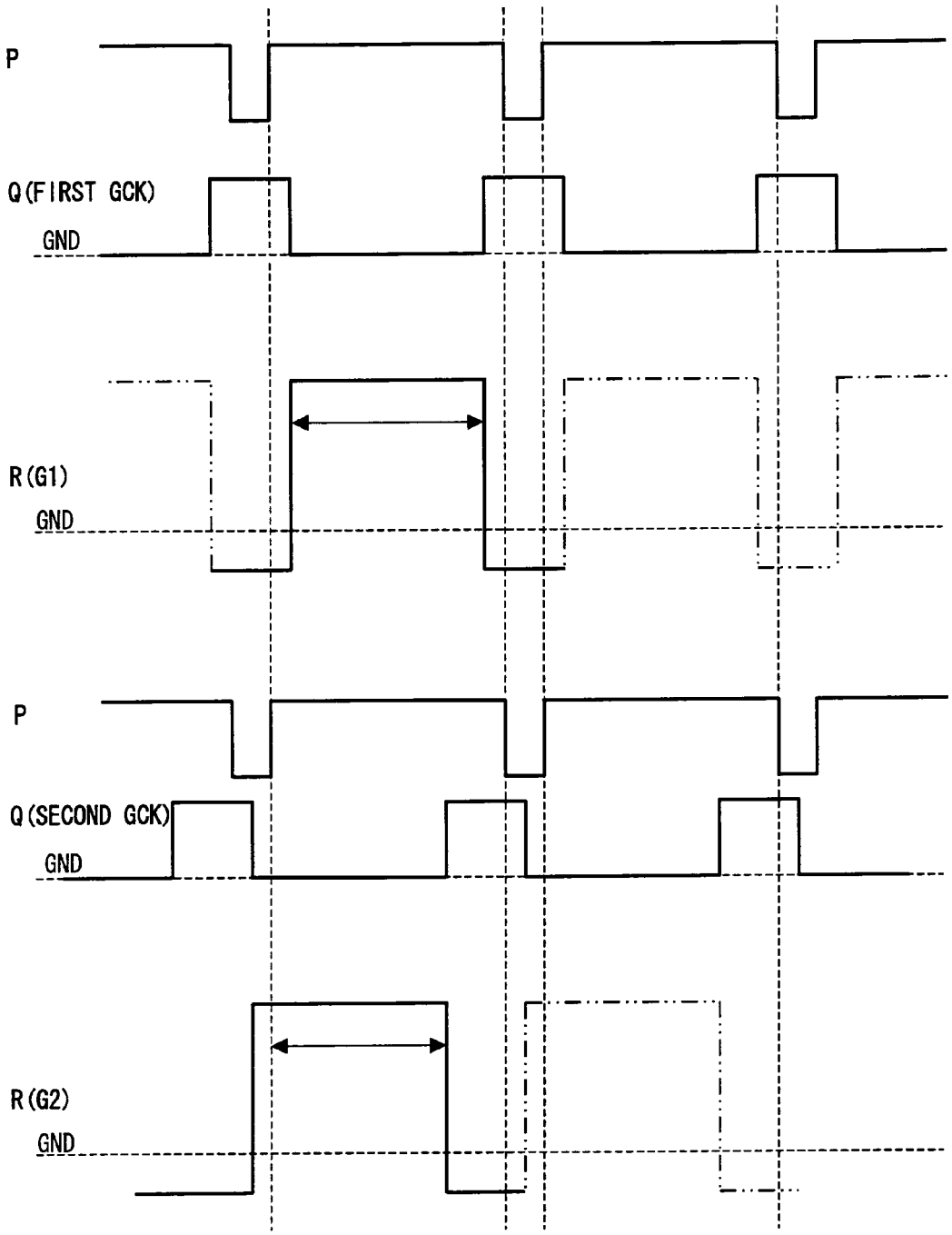
FIG. 23 is a timing chart illustrating waveforms of an output of a data signal, a first GCK, a first scan signal, a second GCK, and a second scan signal.

FIG. 23 shows each of waveforms P through R, where: P is a data signal; Q is a signal (first GCK) supplied to the first gate driver GDF from the first timing controller 5; and R is a voltage pulse signal (a waveform of the first scan signal G1 during its active period) generated by the first gate driver GDF. The first gate driver GDF selects a voltage (nonselective voltage) supplied from the nonselective voltage generating circuit 25 while an input signal (first GCK) of "H" is being supplied from the first timing controller 5. Whereas, while the first GCK of "L" is being supplied, the first gate driver GDF selects a voltage (scan voltage) supplied from the scan voltage generating circuit 9. This leads to a generation of a voltage pulse having a rectangular shape as shown by R. Then, the first gate driver GDF outputs, to the scan signal lines (GF1 through GFk), a first scan signal (gate on pulse signal) in which such a voltage pulse rises in an active period of the first scan signal.

The timing adjusting section 5*b* adjusts the timing of the first GCK, and the timing adjusting section 6*b* adjusts the timing of the second GCK. For example, as shown in FIG. 23, the first GCK and the second GCK have respective pulse signals (i) whose widths are the same and (ii) which rise at different timings. This allows the first scan signal G1 to have a period (writing time), during which active period and data signal outputting period overlap each other, which is different from that of the second scan signal G2, while the first scan signal G1 and the second scan signal G2 have an identical waveform during their respective active periods.

Accordingly, for example, in a case where luminance in the second region SA becomes higher than luminance in the first region FA in carrying out a display in an identical tone, the timing adjusting section 5*b* and the timing adjusting section 6*b* are set so that (i) a pulse signal of the first GCK falls after a data signal starts being outputted and a next pulse signal rises before the data signal finishes being outputted, and (ii) a pulse signal of the second GCK falls before a data signal starts being outputted and a next pulse signal rises before the data signal finishes being outputted (see FIG. 23). More specifically, the memory 45 stores adjusting data in advance, and the above setting is carried out by the LSI 35 outputting a signal, which is in accordance with the adjusting data, to the timing adjusting section 5*b* and the timing adjusting section 6*b*. Note that the adjusting data is preferable to be set for each panel.

Figure 28:
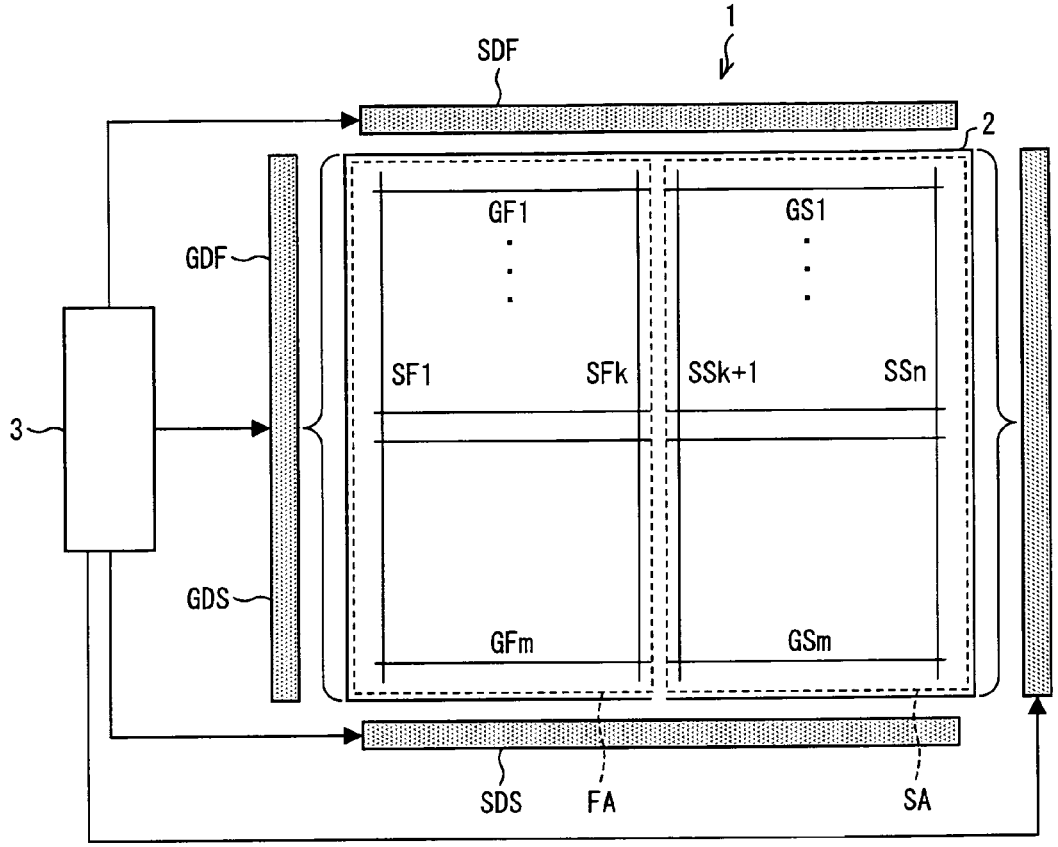
FIG. 28 is a schematic diagram illustrating another configuration of a liquid crystal display device of the present invention.

As shown in FIG. 28, another liquid crystal display device of the present embodiment can have a display section which is divided into a right region and a left region. That is, a display section 2 is divided into (i) a first region FA (left half) including the data signal lines SF1 through SFk and the scan signal lines GF1 through GFm and (ii) the second region SA (right half) including the data signal lines SSk+1 through SSn and the scan signal lines GS1 through GSm. Each of the first and second regions (FA and SA) is separately driven. According to the configuration, (i) the data signal lines SF1 through SFk, which are included in the first region FA, are driven by the first source driver SDF and (ii) the scan signal lines GF1 through GFm, which are included in the first region FA, are driven by the first gate driver GDF, whereas (iii) the data signal lines SSk+1 through SSn, which are included in the second region SA, are driven by the second source driver SDS and (iv) the scan signal lines GS1 through GSm, which are included in the second region SA, are driven by the second gate driver GDS.

In the present embodiment, the first timing controller 5 and the second timing controller 6 include the timing adjusting sections, respectively. However, the present invention is not limited to the configuration. Alternatively, it is possible that only one of the first and second timing controllers includes the timing adjusting section.

Figure 29:
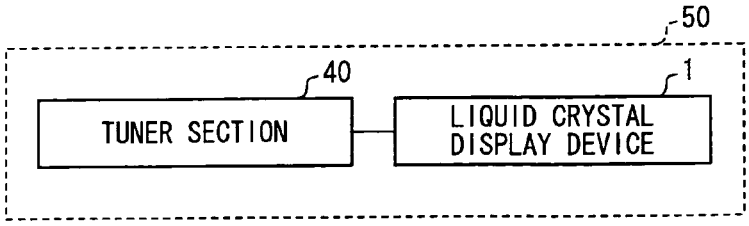
FIG. 29 is a block diagram illustrating a configuration of a television receiver of the present invention.
Figure 30:
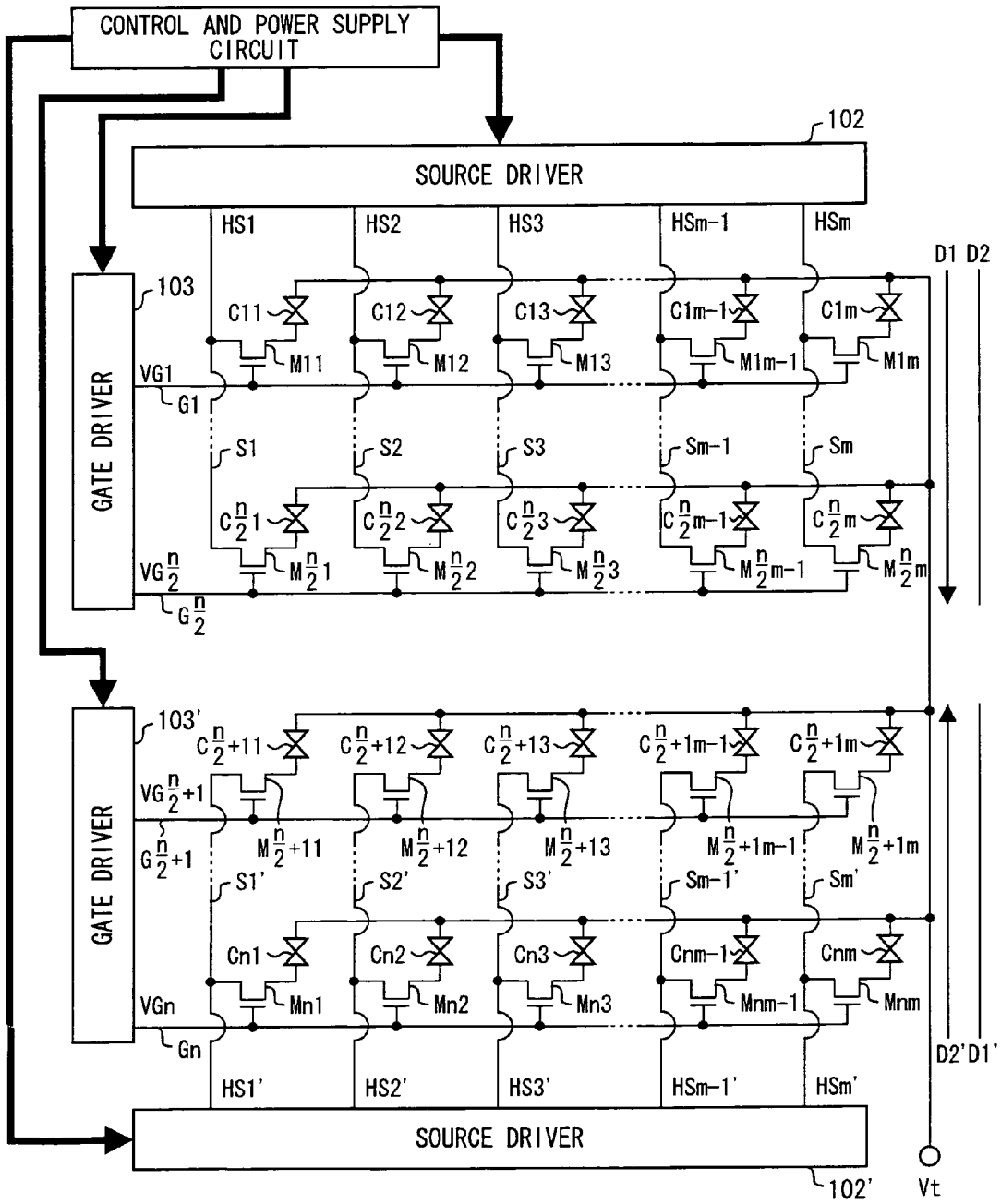
FIG. 30 is a circuit diagram illustrating a configuration of a conventional liquid crystal display device.

As shown in FIG. 29, a television receiver (a liquid crystal TV) of the present embodiment includes: a liquid crystal display device 1; and a tuner section 40 which receives television broadcasting and outputs a video signal. According to the television receiver 50, the liquid crystal display device 1 carries out a video (image) display in accordance with the video signal outputted from the tuner section 40.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The display device of the present invention is suitably applicable, in particular, to a liquid crystal display device such as a liquid crystal TV.

The invention claimed is:

1. A display device comprising:

a display section in which a plurality of data signal lines and a plurality of scan signal lines are provided, the display section including (i) a first region including some of the plurality of scan signal lines to which a first scan signal is sequentially supplied and (ii) a second region including the others of the plurality of scan signal lines to which a second scan signal is sequentially supplied; and a waveform adjusting section which causes the first scan signal to have a waveform, during an active period, which is different from a waveform which the second scan signal has during an active period.

2. A display device as set forth in claim 1, further comprising:

a waveform adjusting section controlling circuit which controls the waveform adjusting section in accordance with inputted adjusting data.

3. A display device as set forth in claim 2, further comprising:

a memory which stores the adjusting data.

4. The display device as set forth in claim 1, wherein:

each of the first scan signal and the second scan signal at least partially has a slope falling edge at an end of the active period.

5. The display device as set forth in claim 4, wherein:

the waveform adjusting section causes the first scan signal to have a degree, to which the falling edge slopes, which is different from a degree of the second scan signal.

6. A display device as set forth in claim 1, further comprising:

a first scan signal line driving circuit corresponding to the first region; and a second scan signal line driving circuit corresponding to the second region, the first scan signal line driving circuit generating the first scan signal in accordance with a first scan voltage, and the second scan signal line driving circuit generating the second scan signal in accordance with a second scan voltage.

7. A display device as set forth in claim 6, further comprising:

a first scan voltage generating circuit which generates the first scan voltage; and a second scan voltage generating circuit which generates the second scan voltage, at least one of the first scan voltage generating circuit and the second scan voltage generating circuit including the waveform adjusting section.

8. The display device as set forth in claim 1, wherein:

the display panel is divided into a first region including an upper half of the plurality of scan signal lines and a second region including a lower half of the plurality of scan signal lines, a direction orthogonal to the plurality of scan signal lines being an up-and-down direction.

9. The display device as set forth in claim 1, wherein:

the display panel is divided into a first region including a left half of the plurality of scan signal lines and a second region including a right half of the plurality of scan signal lines, a direction in which the plurality of scan signal lines are extended being a horizontal direction.

10. A control device for use in a display device, said display device, comprising:

a display section in which a plurality of data signal lines and a plurality of scan signal lines are provided, the display section including (i) a first region including some of the plurality of scan signal lines and (ii) a second region including the others of the plurality of scan signal lines, first and second scan signals being generated so as to correspond to the first and second regions, respectively; and a waveform adjusting section which causes the first scan signal to have a waveform, during an active period, which is different from a waveform which the second scan signal has during an active period.

* * * * *